United States Patent [19]

Ishiguro et al.

[11] Patent Number: 4,893,152

[45] Date of Patent: Jan. 9, 1990

[54] COPYING APPARATUS HAVING A SORTER WITH A SHEET BINDING FUNCTION

[75] Inventors: Kuniaki Ishiguro; Takuma Ishikawa, both of Osaka, Japan

[73] Assignee: Minolta Camera Kabushiki Kasha, Osaka, Japan

[21] Appl. No.: 243,797

[22] Filed: Sep. 13, 1988

[30] Foreign Application Priority Data

Sep. 16, 1987 [JP] Japan ..... 62-231500
Sep. 16, 1987 [JP] Japan ..... 62-231501

[51] Int. Cl.[4] ..... G03G 21/00

[52] U.S. Cl. ..... 355/323; 270/53; 270/58; 271/3.1; 271/289; 355/72; 355/324; 412/33

[58] Field of Search ..... 355/26, 72, 75, 97, 355/319, 323, 324, 321, 133, 55, 206, 309, 244; 271/4, 9, 3.1, 184, 293, 246, 258, 265, 289; 270/58, 53, 52.5, 37; 156/356; 412/33

[56] References Cited

U.S. PATENT DOCUMENTS

| | | | |
|---|---|---|---|
| 3,386,729 | 6/1968 | Pine | 270/52.5 |
| 3,645,615 | 2/1972 | Spear | 271/9 X |
| 3,697,063 | 1/1972 | Greenfield et al. | 271/4 |
| 3,709,595 | 1/1973 | Turner et al. | 355/97 X |
| 3,944,207 | 3/1976 | Bains | 270/58 |
| 4,067,649 | 1/1978 | Hubbard et al. | 271/9 X |
| 4,073,391 | 2/1978 | O'Brien et al. | 271/246 X |
| 4,076,408 | 2/1978 | Reid et al. | 271/258 X |
| 4,123,155 | 10/1978 | Hubert | 355/26 |
| 4,134,672 | 1/1979 | Burlew et al. | 355/324 |
| 4,145,037 | 3/1979 | Mol | 270/58 |
| 4,190,246 | 2/1980 | Sasuga | 271/265 X |
| 4,203,587 | 5/1980 | Kishi et al. | 271/293 |
| 4,218,128 | 8/1980 | Satomi et al. | 355/26 X |
| 4,227,275 | 10/1980 | Soderberg | 227/44 X |
| 4,238,066 | 12/1980 | Brooke | 227/39 |
| 4,248,413 | 2/1981 | Fox | 270/53 |
| 4,248,525 | 2/1981 | Sterrett | 355/323 |
| 4,265,440 | 5/1981 | Shibazaki et al. | 271/9 |
| 4,272,180 | 6/1981 | Satomi et al. | 271/3.1 X |
| 4,281,920 | 8/1981 | Cross | 355/75 |
| 4,295,733 | 10/1981 | Janssen et al. | 355/323 |
| 4,313,670 | 2/1982 | Caldwell | 355/324 |
| 4,361,393 | 11/1982 | Noto | 355/323 |

(List continued on next page.)

FOREIGN PATENT DOCUMENTS

| | | |
|---|---|---|
| 99250 | 1/1984 | European Pat. Off. . |
| 2732673 | 9/1978 | Fed. Rep. of Germany . |
| 3701450 | 7/1987 | Fed. Rep. of Germany . |
| 57-203037 | 5/1982 | Japan . |
| 57-131667 | 8/1982 | Japan . |
| 59-43765 | 3/1984 | Japan . |
| 60-183461 | 9/1985 | Japan . |
| 60-248563 | 12/1985 | Japan . |
| 61-26061 | 6/1986 | Japan . |
| 61-145069 | 7/1986 | Japan . |
| 610261096 | 11/1986 | Japan . |
| 2185465 | 7/1987 | United Kingdom . |

OTHER PUBLICATIONS

IBM Technical Bulletin, vol. 18, No. 9, 2/76.

*Primary Examiner*—Richard A. Wintercorn
*Attorney, Agent, or Firm*—Burns, Doane, Swecker & Mathis

[57] ABSTRACT

A copying apparatus includes a sorter which has a plurality of bins, a binding unit for binding the sheets taken-out from each of the bins, a first path for transporting the sheets ejected from a copying machine to the sorter, a second path for transporting the sheets to the binding unit. Sheets are conducted to the first path when a sorting mode is selected, but to the second path regardless of the selection of the sorting mode when the input number of copy sets is 1. Further, the copying apparatus includes a first roller and a second roller for taking-out the sheets from the bins, wherein, the second roller is moved down to pinch the sheets on the bin in cooperation with the first roller when the bin reaches the sheet take-out position, and then the sheets on the bin are taken-out to the binding unit by the rotation of the rollers.

3 Claims, 40 Drawing Sheets

U.S. PATENT DOCUMENTS

| | | | |
|---|---|---|---|
| 4,365,886 | 12/1982 | Murakami et al. | 271/3.1 X |
| 4,368,972 | 1/1983 | Naramore | 355/323 |
| 4,371,155 | 2/1983 | Astero et al. | 270/53 |
| 4,376,529 | 3/1983 | George et al. | 270/53 |
| 4,385,827 | 5/1983 | Naramore | 355/323 |
| 4,411,515 | 10/1983 | Kukucka et al. | 355/321 |
| 4,424,963 | 1/1984 | Bartholet et al. | 355/324 X |
| 4,473,425 | 9/1984 | Baughman et al. | 156/356 |
| 4,497,478 | 2/1985 | Reschenhofer et al. | 270/53 |
| 4,515,458 | 5/1985 | Masuda et al. | 271/289 X |
| 4,549,804 | 10/1985 | Braun et al. | 355/324 |
| 4,564,185 | 1/1986 | Hamlin et al. | 270/53 |
| 4,566,782 | 1/1986 | Britt et al. | 355/324 |
| 4,573,789 | 3/1986 | Wada | 355/319 |
| 4,582.421 | 4/1986 | Hamlin et al. | 355/72 |
| 4,592,651 | 6/1986 | Oikawa et al. | 355/72 |
| 4,595,187 | 6/1986 | Bober | 270/37 |
| 4,603,971 | 8/1986 | Kukucka et al. | 355/133 |
| 4,626,156 | 12/1986 | Baughman et al. | 412/33 |
| 4,647,034 | 3/1987 | Sawa | 271/293 |
| 4,647,188 | 3/1987 | Komiya et al. | 355/55 |
| 4,674,732 | 6/1987 | Hori | 270/53 |
| 4,674,866 | 6/1987 | Tanaka | 355/23 |
| 4,687,191 | 8/1987 | Stemmle | 270/53 |
| 4,702,589 | 10/1987 | Ito | 355/319 |
| 4,718,657 | 1/1988 | Otter et al. | 271/184 |
| 4,721,382 | 1/1988 | Ito et al. | 355/206 |
| 4,730,206 | 3/1988 | Sawada et al. | 355/309 |
| 4,743,945 | 5/1988 | Ito et al. | 355/244 |
| 4,763,889 | 8/1988 | Dei et al. | 271/9 |

COPYING APPARATUS HAVING A SORTER WITH A SHEET BINDING FUNCTION

BACKGROUND OF THE INVENTION

1. Field of the Invention

The present invention relates to a copying apparatus, and more particularly, a copying apparatus having a sorter so that sheets having images transcribed by a copying machine can be distributed and bound accordingly after being ejected from the copying machine.

2. Description of Related Art

Recently, responding to the increasing demand for automated paper handling systems for copying machines, optional systems such as the automatic document feeding system and the sorting system designed for sorting or grouping copied sheets have been developed and commercialized in various types. The users of the copying machines are now requiring the sorter-finisher system capable of automatically binding and stacking sheets which have been distributed in the sorting system, and this type sorter-finisher system has already been commercialized for some of large-sized copying machines.

A conventional sorter-finisher is so constructed that sheets distributed in each bin are taken-out therefrom and transported to a stapling unit to undergo a stapling process. To operate the sorting and stapling processes in a sequence is effective for processing plural sets of duplication sheets. However, the sequential operation is indiscreetly carried out even in the case that one set of duplication sheets is to be processed, when the sheets are compelled to be transported an extensive distance to a sorter causing more trouble and consuming excessive time.

With regard to mechanisms for transporting sheets in each bin to a stapling unit, U.S. Pat. Nos. 4,361,393 and 4,248,525 disclose a mechanism for taking-out sheets in each bin with a pivotal arm, and a mechanism for transporting sheets to a stapling unit by means of a feeder. However, such a mechanism with the pivotal arm or feeder is essentially complicated and bulky, and also inapplicable to a compact size copying machine for general use.

In view of the above, the inventors of the present invention devised a mechanism: each bin carrying a stack of sheets is tilted to a sheet take-out position to make the stack of sheets slide down by its own weight to a transport position leading to a stapling unit, where a guide roller and a pinch roller cooperate to secure the movement of the stack of sheets. However, the above mechanism must be provided with countermeasures for preventing the sheets from slipping off the bin that is tilting down to the sheet take-out position, as well as for securely taking-out the sheets from the bin even when the sheets are curled.

SUMMARY OF THE INVENTION

In view of above-mentioned problems, an object of the present invention is to provide a copying apparatus causing less trouble by transporting sheets directly to a binding unit, i.e. reducing the transport path length and the processing time for sheets when no sorting process is required.

Another object of the present invention is to provide a simple and compact copying apparatus capable of effectively preventing sheets form slipping off each bin that is tilting down to a sheet take-out position by guiding one end of the sheets, as well as being capable of securely taking-out the sheets from each bin even when the sheets are curled upward.

To attain the above-mentioned object, a copying apparatus according to the present invention comprises: an image forming means for copying an original image on the predetermined number of sheets; a sorting means for distributing the sheets ejected from said image forming means to a plurality of bins; a binding means for binding the sheets taken-out from each of the bins; a first path for transporting the sheets formed an original image thereon by said image forming means to said sorting means; a second path for transporting the sheets formed an original image thereon by said image forming means to said binding means; a diverting means for diverting the sheets to either said first path or said second path; an inputting means for inputting the number of copy sets to be prepared from one original; a designation means for designating a sorting mode; a first control means for controlling said diverting means to conduct sheets to said first path in accordance with the designation of the sorting mode; and a second control means for controlling said diverting means to conduct sheets to said second path regardless of said first control means when the input number of copy sets is 1.

With the copying apparatus constructed as above, the following functions are obtained. When the number of copy sets for duplication is input to be two or more and a sorting mode is designated, the diverting means is driven to conduct each sheet toward the sorting means. In this case, each sheet is subsequently distributed to the bins, and then transported to the binding means to undergo a binding process. On the other hand, when the number of copy sets for duplication is input to be one, the diverting means is driven to conduct each sheet directly to the binding means to carry out the binding process without transporting the same to the sorting means.

Further, a copying apparatus according to the present invention comprises: an image forming means for copying an original image on sheets; a sorting means having a plurality of bins stacked in the vertical direction, each of which has an opening at its end portion; a sheet take-out means disposed under said sorting means and having a first roller and a second roller which is movable between an actuating position, in which said second roller presses on said first roller and a non-actuating position, in which said second roller is moved away from said first roller; a bin driving mechanism for causing each of the bins to move down to the sheet take-out position at which said first roller contacts with the lower surface of the sheets through said opening of said bin; a guide member movable between a first position for guiding the end of the sheets on each of the bins moving to the sheet take-out position and second position for guiding the upper surface of the sheets being taken-out from each of the bins at the sheet take-out position; a second roller driving mechanism for holding said second roller at the non-actuating position while each of the bins moves to the sheet take-out position and for moving said second roller to the actuating position when each of the bins reaches the sheet take-out position, wherein the sheets on said bin are pinched by said first roller and said second roller and taken-out from said bin; a guide member driving mechanism for holding said guide member at the first position while each of the bins moves to the sheet take-out position and for moving said guide member to the second position when each of the bins reaches the sheet take-out position; and a binding means for binding the sheets taken-out from each of the bins.

With the copying apparatus constructed as above, when each of the bins carrying a stack of sheets is tilting to the sheet take-out position, the guide member prevents the sheets from slipping off the rear end of the bin. The second roller is ordinarily retracted behind the guide member so as not to catch the sheets. When the bin finishes tilting to the sheet take-out position, the end (forward end for the sheet take-out operation) of the sheets is pushed up by the first roller. Meanwhile the guide member moves over to the upper surface of the sheets. Subsequently the second roller is moved to a position protruding from the guide member to pinch the sheets with the first roller. Then, the rollers are rotated together to take-out the sheets from the bin to transport the same toward the binding means. When the sheets are taken-out from the bin, the upper surface of the sheets is guided by the guide member, while the lower surface of the sheets is guided by the first roller preferably in cooperation with a sheet guide member adjacent the first roller.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENTS

The preferred embodiments of the present invention will be described below with reference to the drawings.

(Composition of whole system)

Figure 1:
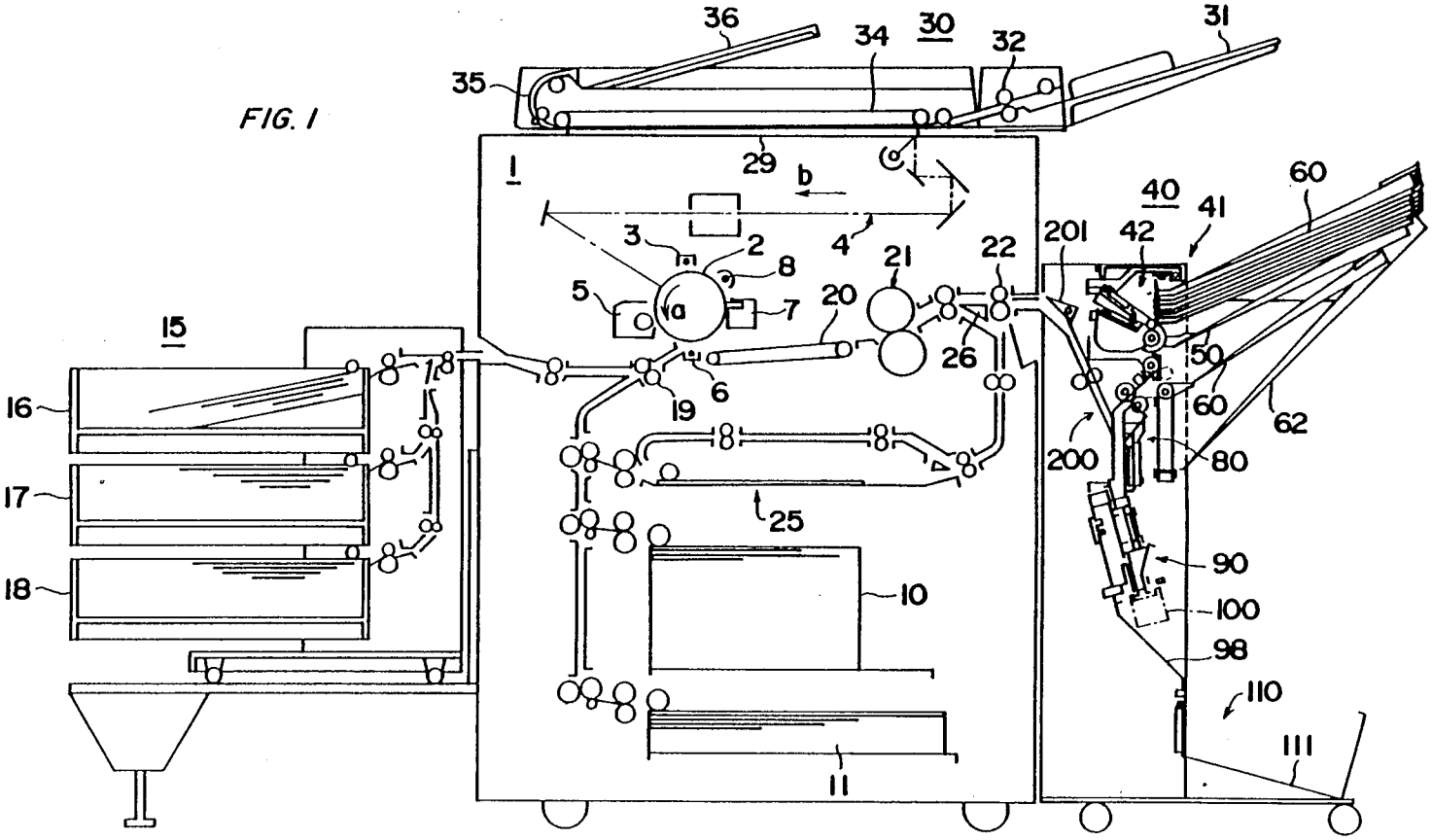
FIG. 1 is a schematic block diagram showing a copying machine and a sorter-finisher.

A sorter-finisher 40 is designed to be installed on the side of a copying machine 1 as shown in FIG. 1, and the copying machine 1 is provided with an automatic paper feeding unit 15 and an automatic document feeding unit 30 (hereinafter referred to as ADF).

The copying machine 1 operates on the principle of the commonly known electro-photography. In this copying machine 1, a photosensitive drum 2 to be turned towards the direction of an arrow a is charged with a certain amount of static electricity by a static electricity charger 3, and the document set to a specified position by the ADF 30 is exposed to the light through a slit when an optical system 4 scans the document towards the direction of an arrow b. This causes the electrostatic latent image formed on the photosensitive drum 2 to be developed into a toner image by a magnetic brush type developing device 5 and then transferred onto a sheet by a transfer charger 6.

Copying sheets fed one by one selectively from the elevator type and cassette type automatic paper feeders 10 and 11 built in the copying machine 1 or the 3-stage paper feed cassettes 16, 17 and 18 of the automatic paper feeder 15 installed outside the copying machine 1 is transported to a transferring portion by a timing roller couple 19 with specified timing. The sheet carrying an original image is delivered to a fixing unit 21 by a conveyor belt 20 for fixing the toner image. Then, the sheet is transported to a sorting unit 41 by an ejection roller couple 22 while the passage of the sheet is detected by an ejection switch SW3 (Refer to FIG. 2) provided immediately before the ejection roller couple 22. The copying machine 1 has a built-in paper re-feeder 25, which enables duplex copy and composite copy, and a sheet transport selection click 26 is provided before the ejection roller couple 22.

On the other hand, the photosensitive drum 2 is continued to turn towards the direction of the arrow a even after the toner image is transferred so that the residual toner can be removed by a blade-type cleaner 7, and simultaneously the residual electrostatic charge is erased by an eraser lamp 8 in order to prepare for the next copying operation.

The ADF 30 itself is commonly known and designed to feed documents placed on a document tray 31 one by one using a feed roller couple 32 and is set to a specified position on a glass member 39 of document rest by the rotary motion of a conveyor belt 34. After the exposure of the document image, the document is ejected onto an ejection tray 36 through a transfer pass 35 as the conveyor belt 34 turns.

Figure 2:
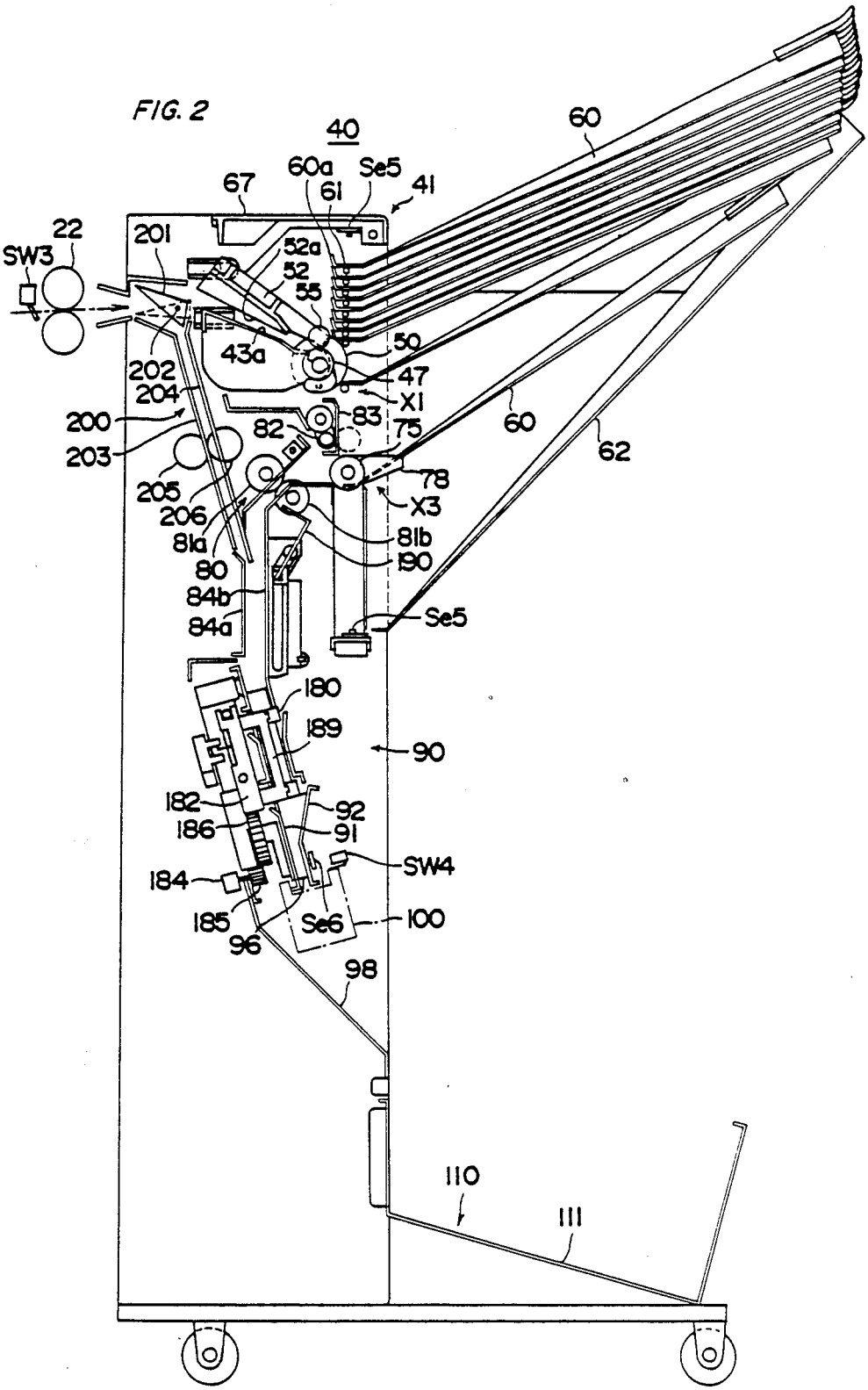
FIG. 2 is an internal composition of the sorter-finisher.

As shown in FIG. 2, the sorter-finisher 40 comprises a sorting unit 41 for distributing sheets among bins 60, a stapling unit 90 with a stapler 100 for stapling the sheets and a stacking unit 110 for stacking the stapled sheets. In this sorter-finisher 40, the stapling unit 90 is disposed below the sorting unit 41, and the stacking unit 110 is disposed below the stapling unit 90.

(Composition and Operation of Sorting Unit)

Before beginning a precise discussion of a sorting unit 41, the following provides a brief description of a path 200 and a diverter 201.

Referring to FIG. 2, the diverter 201 is pivotally supported at a pin 202 and made movable from a position indicated by a dotted line to a position indicated by a solid line by turning on a solenoid operatively connected thereto. The diverter 201 is ordinarily put in the position of the dotted line to conduct sheets ejected one by one from the copying machine 1 to the sorting unit 41. When the diverter 201 is driven to move in the position of the solid line by turning on the solenoid, sheets are conducted to the path 200 to be transported onto a staple tray 91 of a stapling unit 90. The above-mentioned operation of the diverter 201 is discussed in detail in a flow chart hereinafter.

The path 200 comprises guide plates 203 and 204, a sheet transport roller 205 and a pinch roller 206 which presses against the roller 205 for being driven in association therewith. The guide plates 203 and 204 have their upper ends contiguous to a sheet diverting position of the diverter 201, and lower ends contiguous to a position where a guide plate 84*a* conducts sheets to the staple tray 91 thereby enabling sheet transport from the sheet diverting position to the staple tray 91. The sheet transport roller 205 is capable of rotating by a drive motor to help transport sheets therethrough when the path 200 is selected.

As shown in FIGS. 2 through 8, a plurality of clicks 60*a* for preventing the reverse flow of sheets and a pair of trunnions 61 are provided on one end of each of the bins 60. The trunnions 61 engage with a groove 65*a* extending longitudinally along a pair of guide units 65 (only one is shown in FIGS. 3 through 7) installed on a frame of the sorter-finisher 40 in order to regulate the movements of the bins 60 along the longitudinal direction. Another end of each of the bins 60 is supported by a bin holder 62. Floating cams 50, which will be explained later, shift the position of the trunnion 61 so that the intervals of the bins 60 can be increased.

Figure 3:
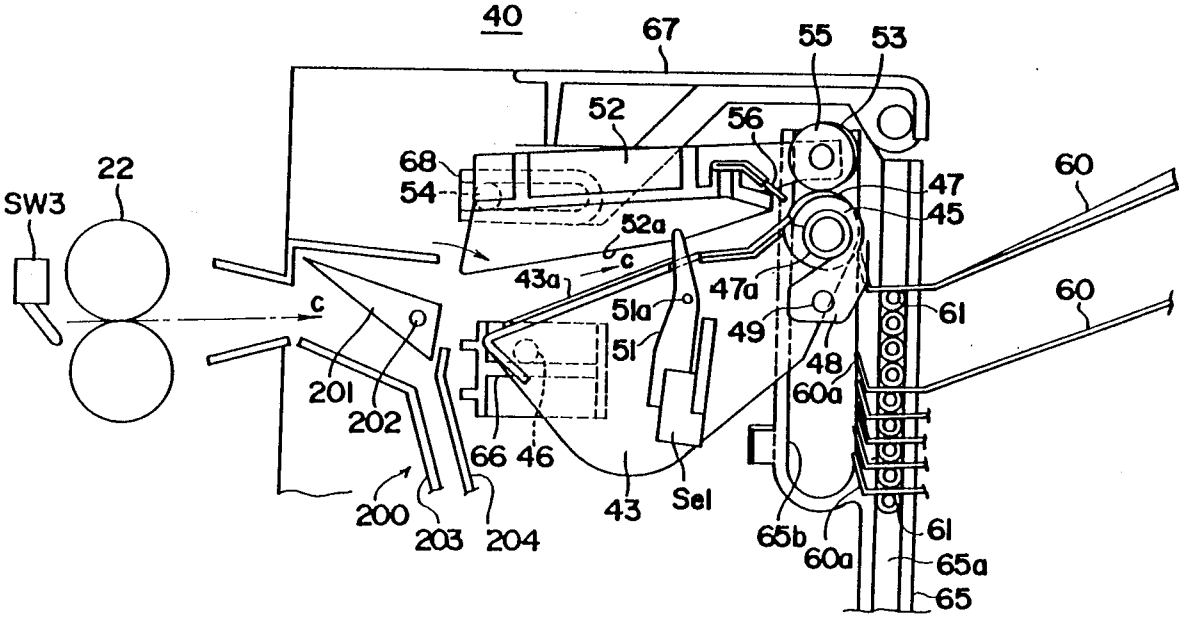
FIG. 3 is an internal composition of a sorting unit.

The sorting unit 41 distributes the sheets ejected from the copying machine 1 through relative upward and downward movement between a sheet transport unit 42 disposed opposite to the ejection roller couple 22 of the copying machine 1 and bins 60. As shown in FIG. 3, the sheet transport unit 42 comprises an upper unit 52 having a guiding surface 52*a*, a lower unit 43 having a guiding surface 43*a*, a feed roller 47 and a pinch roller 55 so that the sheet from the rollers 47 and 55 is transported to each bin 60 passing between the guiding surfaces 52*a* and 43*a*.

Figure 4:
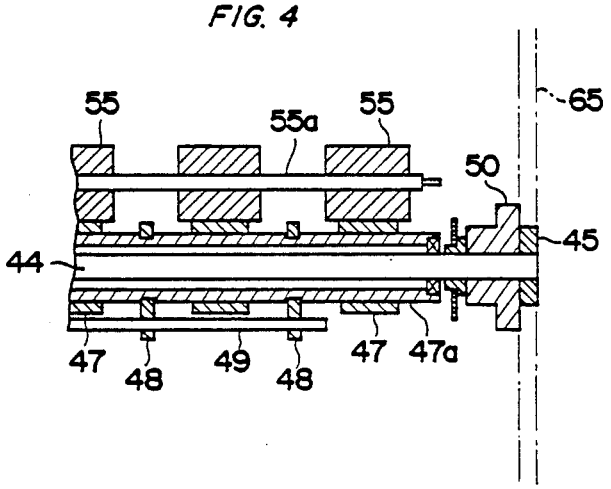
FIG. 4 is a horizontal cross-sectional view of a feed roller section of the sorting unit.
Figure 5:
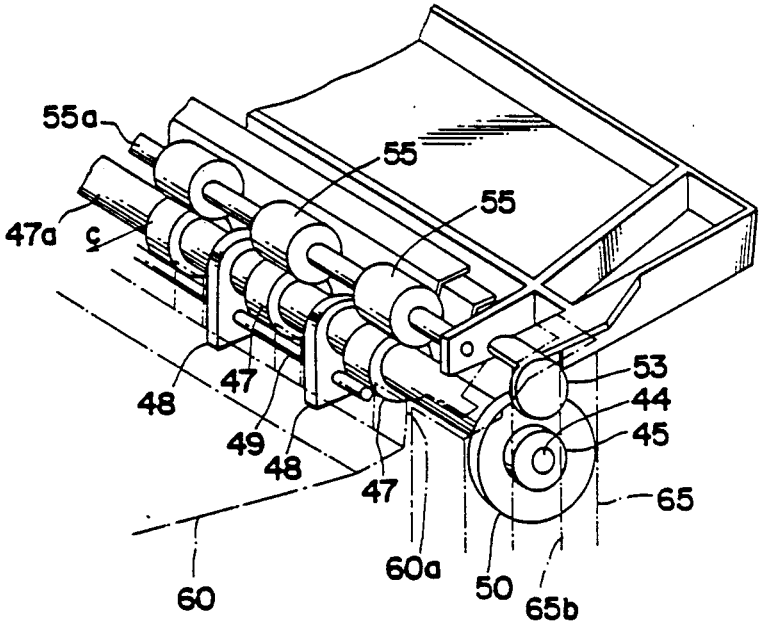
FIG. 5 is a perspective view of a conveyance unit.

One end of the lower unit 43 is supported movably in upward and downward directions by a supporting shaft 44 disposed on the side of the bins 60 orthogonally to the sheet transporting direction indicated by an arrow c. Both ends of the shaft 44 engage with a rail unit 65*b* installed on the guide unit 65 through a collar 45 as shown in FIGS. 4 and 5. Another end of the lower unit 43 has a pin 46 which is supported slidably on a guide member 66.

Figure 6:
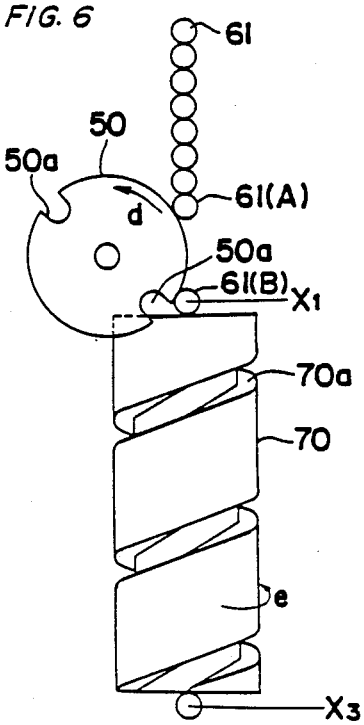
FIG. 6 is an explanatory drawing of a floating cam and a fixed cam.
Figure 7:
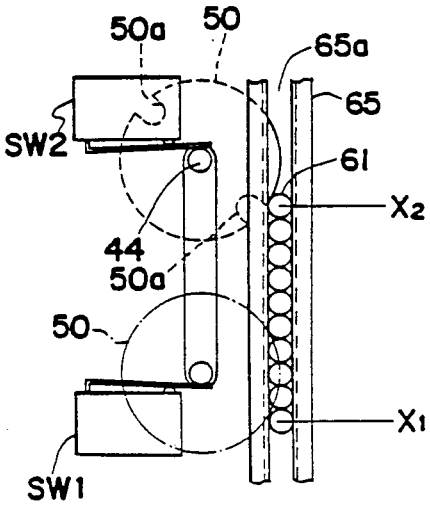
FIG. 7 is an explanatory drawing of the floating cam.

A roller shaft 47*a* whereto plural number of feed rollers 47 are fixed is installed on the supporting shaft 44 in a manner to permit the free rotation of the roller shaft 47*a*, and oscillating plates 48 are hung from the roller shaft 47*a*. The oscillating plates 48 are connected to each other by a rod 49, and the lower part of the oscillating plates 48 are located between the reverse flow prevention clicks 60*a* of the bins 60. Besides, as shown in FIGS. 6 and 7, the floating cams 50 with notches 50*a* and 50*a* formed on the circumferential surface at intervals of 180° are fixed to both ends of the supporting shaft 44. These floating cams 50 are turned 180° intermittently by the driving source separate from that of the feed rollers 47 and support not only the lower unit 43 but also the rear ends of bins 60 by means of the trunnions 61 which come to contact their circumferential surface. Furthermore, as shown in FIG. 7, the floating cam 50 can move up and down between a bottom bin position X1 and a top bin position X2, and the cam 50 can be detected by detection switches SW1 and SW2 when it has reached these positions X1 and X2. As shown in FIG. 3, the lower unit 43 is provided with an actuator 51 which turns freely round a pin 51*a* and a photosensor Se1 which can be turned on and off when the actuator 51 turns keeping in contact with the sheet to be transported.

One end of the upper unit 52 has an engaging piece 53 which engages slidably with the rail unit 65*b* thereby oscillating up and down. The other end of the upper unit 52 has a pin 54 which engages slidably with a guide member 68 provided to a top cover 67 of the sorter 40 thereby sliding in horizontal direction. Pinch rollers 55 are installed pivotally to the upper unit 52 through a supporting shaft 55*a*. Also, a neutralizing brush 56 is installed to the upper unit 52. The pinch rollers 55 pressed against the feed rollers 47 utilizing their own weight, which are capable of being driven by the feed rollers 47.

A transmission type photosensor Se5 (Refer to FIG. 2) whose optical axis is located at the rear end of each bin 60 is installed in the sorting unit 41 so that the presence or absence of the sheets distributed among and in the bins 60 can be detected.

In the above-described composition, the floating cam 50 introduces the trunnion 61 kept in contact with the circumference into the notch 50*a* by every 180° turn in the direction reverse to the direction of an arrow d, thereby not only causing itself to move upward but also causing the introduced trunnion 61 to shift downward to contact the next trunnion 61. Repeating this action causes each bin 60 to shift downward by one step, while the transport unit 42 moves upward. When the sorting mode is selected, the floating cam 50 is located at the bottom bin position X1 as shown in FIG. 7, and this cam 50 increases the intervals of the bins 60 as it moves upward step by step from this position. The sheets ejected from the copying machine 1 pass between the guiding surfaces 52*a* and 43*a* and between the feed rollers 47 and the pinch rollers 55 into the bins 60 whose intervals are widened by the floating cam 50. Turning the floating cam 50 towards the normal direction or the direction of the arrow d causes the bins 60 to shift upward one by one, and the cam 50 moves downward together with the transport unit 42.

In the sorting unit 41 having the above-described composition, the sheets can be stored in three different modes. The first mode is the sorting mode to enable the sheet formed on each document image to be distributed among the bins 60 and sorted in the order of page number. The second mode is the grouping mode to enable the sheets formed on the same image to be distributed among the same bins 60. The third mode is the non-sorting mode to enable the sheets to be stored (not to be distributed) only in one bin 60.

(Construction and Operation of Fixed Cam)

Here, the explanation will be made as to fixed cams 70 and a transport unit 80 which are used for transporting the sheets distributed among the bins 60 to a staple tray 91 which will also be explained in the following.

Figure 8:
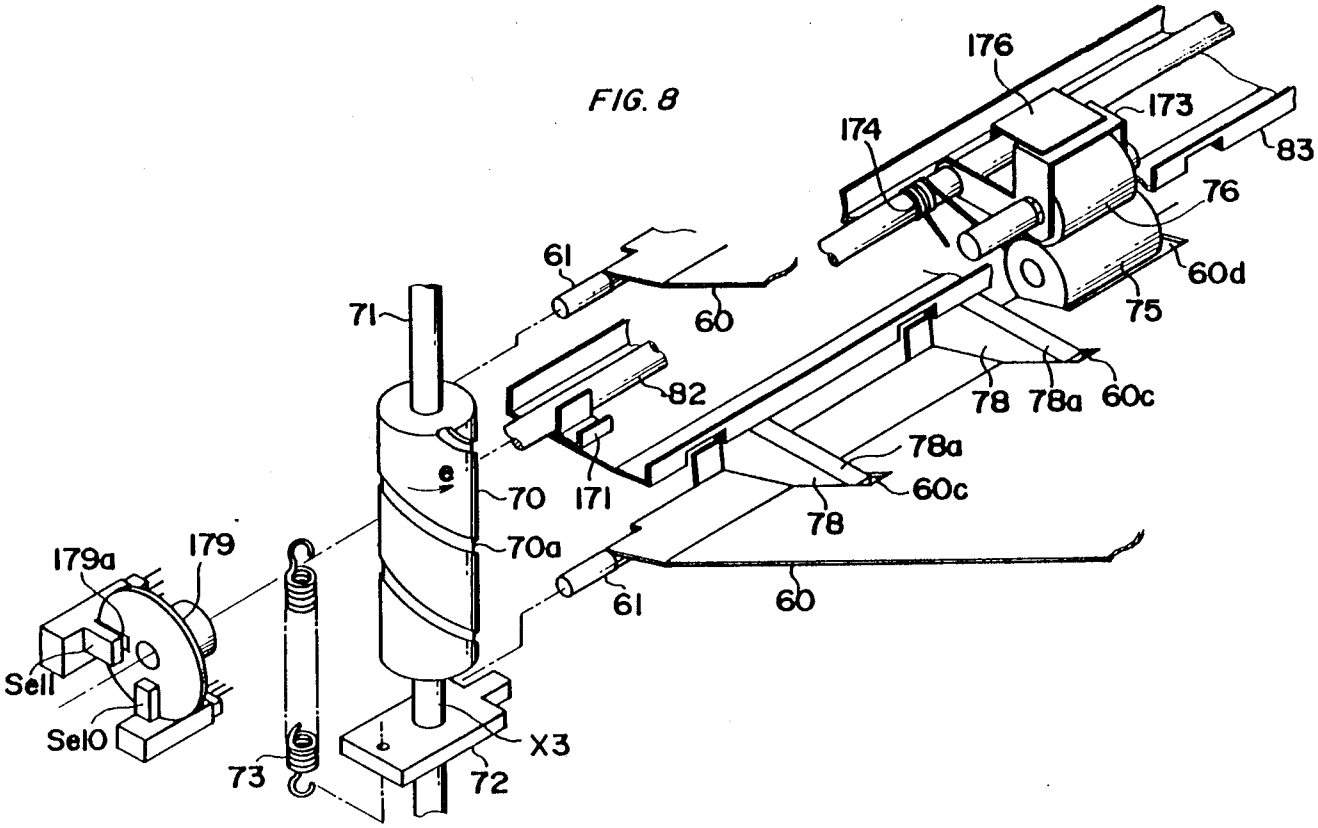
FIG. 8 is a perspective view of a sheet take-out position.
Figure 9:
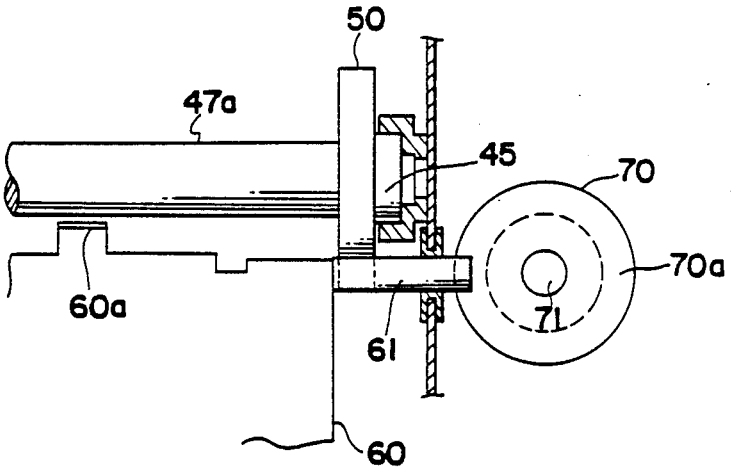
FIG. 9 is a plan view showing a mechanical relationship of a trunnion and the fixed cam.

As shown in FIGS. 6 and 8, the fixed cam 70 has a spiral groove 70*a* formed turning 3 times round the circumferential area of the fixed cam 70 for enabling the engagement of the trunnion 61 and the groove 70*a*, and the fixed cam 70 can be turned both towards the normal direction and reverse direction by a motor not shown in the drawings. That is, the fixed cam 70 turns towards the normal direction or the direction of an arrow e to lower the trunnion 61 of each of the bins 60, which has been shifted to the bottom bin position X1 by the floating cam 50, to a sheet take-out position X3.

On the other hand, as shown in FIG. 8, at the sheet take-out position X3, a receiving member 72 installed to a supporting shaft 71 is not only movable up and down freely along the supporting shaft 71 but also is urged upward by a coil spring 73, thus the trunnion 61 descended to the take-out position X3 supporting flexibly. The take-out position X3 is provided with a take-out roller 75, a guide plate 83 is pivotally supported at a shaft 82 and movable from a position indicated by a solid line to a position indicated by a dotted line as shown in FIG. 2 by unshown motor, a pinch roller 76 which is pressed against the roller 75 in accordance with the movement of the guide plate 83, and sheet guides 78.

As shown in FIG. 8, provided at the sheet take-out position X3 are sheet guides 78 as being capable of protruding from notches 60*c* formed at the rear end of the bin 60 when the bin 60 is tilted to the sheet take-out position X3. The upper surface 78*a* of the sheet guides 78 is positioned on a level slightly above stopper clicks 60*a* of the bin 60 for preventing the sheets from slipping off the bin 60. The take-out roller 75 is provided at the sheet take-out position X3 and made capable of protruding from a notch 60*d* of the bin 60 when the bin 60 is tilted to the sheet take-out position X3. The topmost portion of the take-out roller 75 is positioned on the same level as the upper surface 78*a* of the sheet guides 78 to be able to push up the rear end of the sheets on the bin 60 in cooperation with the sheet guides 78. The sheet take-out roller 75 is made of a spongy material to tolerate the variance in thickness of the sheets taken in between the roller 75 and the pinch roller 76.

Figure 11:
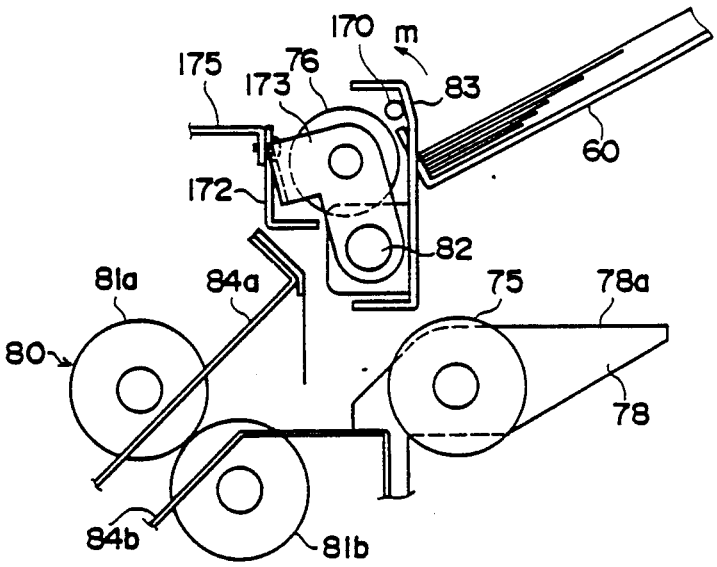
FIGS. 11 and 12 are explanatory drawings showing a movement of a pinch roller and a guide plate.

The guide plate 83 is capable of swinging supported at a shaft 82 and urged toward the direction of an arrow m in FIG. 11 to be ordinarily disposed in an upright position defined by a stopper 170 provided against the rear end of the bin 60. When the shaft 82 is rotated in the direction reverse to the arrow m, the guide plate 83 is pressed by a leaf spring 171 secured to the shaft 82 to be moved into an approximately horizontal position against the upper surface of the stack of sheets in the bin 60 tilted to the sheet take-out position X3. The horizontal is defined by abutting the rear end of the guide plate 83 to a stopper 172.

Figure 12:
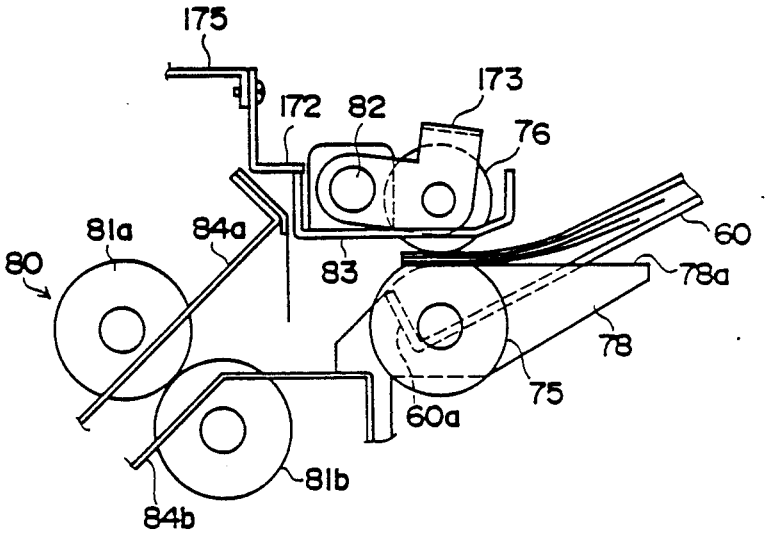

The pinch roller 76 is capable of swinging supported at the shaft 82 by means of a bracket 173, and urged towards the direction of the arrow m in FIG. 11 by a torsion spring 174 in the same manner as the guide plate 83. The pinch roller 76 is initially retracted behind the guide plate 83, and put in a position where the bracket 173 abuts against a frame 175. When the shaft 82 is rotated in the direction reverse to the arrow m, the pinch roller 76 is pressed by a leaf spring 176 secured to the shaft 82 to be moved with the guide plate 83 into a horizontal position as shown in FIG. 12. At this time, the pinch roller 76 continues its swinging motion even after the positioning of the guide plate 83 is completed by the operation of the stopper 172, to protrude downward from the guide plate 83. Consequently, the pinch roller 76 pinches the rear end of the stack of sheets in the bin 60 in cooperation with the take-out roller 75.

As shown in FIG. 8, the shaft 82 is provided at its one end with a disk 179 having a notch 179*a*. By detecting the position of the notch 179*a* with photosensors Se10 and Se11, the swinging motions of the guide plate 83 and the pinch roller 76 are controlled between the respective initial position and the sheet take-out position.

Figure 10:
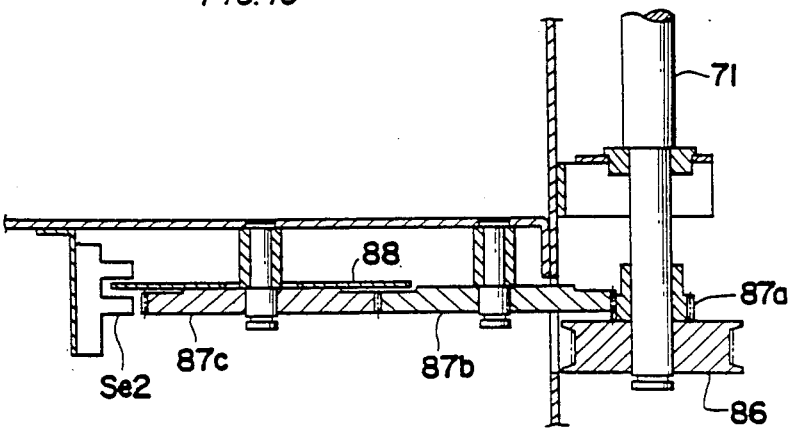
FIG. 10 is a vertical cross-sectional view showing a rotary detector of the fixed cam.

Furthermore, as shown in FIG. 10, a driving pulley 86 and a gear 87*a* are integrally fixed to the lower end of the supporting shaft 71 of the fixed cam 70. The gear 87*a* engages with a gear 87*b* which in turn engages with a gear 87*c*. A disk 88 integrally fixed to the gear 87*c* has a notch not shown in the drawings which is detected by a photosensor Se2 in order to control the number of revolutions of the fixed cam 70.

As shown in FIGS. 2, 11, 12 and 13, the transport unit 80 comprises said rollers 75 and 76, transport rollers 81*a* and 81*b*, and guide plates 84*a* and 84*b*. The transport roller 81*b* is made of rubber material, while the transport roller 81*b* is made of spongy material so that they are able to transport the various thickness of stacked sheets.

In the above-described arrangement, the fixed cam 70 is turned 3 times towards the direction of the arrow e after the sorting unit 41 has completed the distribution of sheets. The trunnion 61 of each of the bins 60 at the bottom bin position X1 is guided by the spiral groove 70*a* to come down to the take-out position X3 where the trunnion 61 is supported with the receiving member 72. At this take-out position X3, the bin 60 inclines at a larger angle than it does at the bottom bin position X1 so that the sheets distributed and stored slide down on the guiding surfaces 78*a* of the guides 78 due to their own weights. The take-out roller 75 overlaps with the bin 60 so that the end of the sheets are caught between the rollers 75 and 76 when the bin 60 has reached the take-out position X3, and then the sheets are transported to the transport rollers 81*a* and 81*b* by the rollers 75 and 76. Even when the sheets are curled downward, the sheets can be transported between the guide plates 84*a* and 84*b* without fail guided over the clicks 60*a* by the guides 78 and the take-out roller 75. Also, even when the sheets are curled upward, the sheets are transported between the guide plates 84*a* and 84*b* guided by the guide plate 83 which is moved to the horizontal position as shown in FIG. 12.

When the guide plate 83 and the pinch roller 76 are put in the respective initial positions as shown in FIG. 11, the guide plate 83 operates to prevent the sheets from slipping off the bin 60 that is tilting toward the sheet take-out position X3. At this time, the pinch roller 76 is retracted behind the guide plate 83 so as not to interfere with the sheet guiding operation of the guide plate 83. When the bin 60 tilts down to the sheet take-out position X3, the shaft 82 begins to be rotated by unshown drive motor to move the guide plate 83 and the pinch roller 76 into their respective positions as shown in FIG. 12. This positioning enables the rollers 75 and 76 to pinch therebetween the end (forward end for the sheet take-out operation) of the stack of sheets.

On the other hand, at the time of sheet take-out operation, as shown in FIG. 6, the floating cam 50 comes to the position corresponding to the bottom bin position X1 and supports the trunnion 61 immediately before being fed to the fixed cam 70 so that the trunnions 61 can be fed to the fixed cam one by one as the floating cam 50 turns 180° intermittently towards the direction reverse of the arrow d. In this embodiment, in order to increase the inclination angle of each of the bins 60 at the take-out position X3 to facilitate the sheets on the bins 60 sliding downward by their own weight, the interval between the bottom bin position X1 and the take-out position X3, that is, the stroke of the bins 60 that is to move between these two points can be made relatively large. Thus, the torque needed rotating the fixed cam 70 can be reduced by a small pitch of the spiral groove 70*a*. The trunnions 61 are moved from the position X1 to the position X3 by 3 times rotations of the fixed cam 70 with reduced torque. The trunnion 61(A) immediately before the trunnion 61(B) is supported by the floating cam 50 is fed to the fixed cam 70 so that the trunnion 61(A) can be prevented from being fed to the spiral groove 70*a* at the time of the second or the third turn of the fixed cam 70.

As explained in the foregoing, as the floating cam 50 turns reversely by 180°, and the fixed cam 70 turns 3 times respectively, the bins 60 are brought down step by step to the take-out position X3, and the sheets distributed among the bins 60 are transported onto the staple tray 91 by the transport unit 80.

Each of the bins 60 brought down to the take-out position X3 is supported by the receiving member 72. And the bin 60 returns to its upward original position by the rotation of the fixed cam 70 towards the direction reverse to the arrow e, and the floating cam 50 towards its normal direction or the direction of the arrow d after all the sheets distributed among the bins 60 are taken-out.

(Construction and Operation of Stapling Unit)

As shown in FIGS. 2, 13, 14 and 15, the stapling unit 90 comprises the staple tray 91, an upper guide plate 92, a side regulating plate 180 for aligning sheets on the staple tray 91, a reference guide plate 189, a longitudinal regulating plate 190, a stopper 96 and a stapler 100.

In the staple tray 91, the longitudinal regulating plate 190 and the stopper 96 align sheets longitudinally, meanwhile the side regulating plate 180 and the reference guide plate 189 align sheets laterally.

Figure 16:
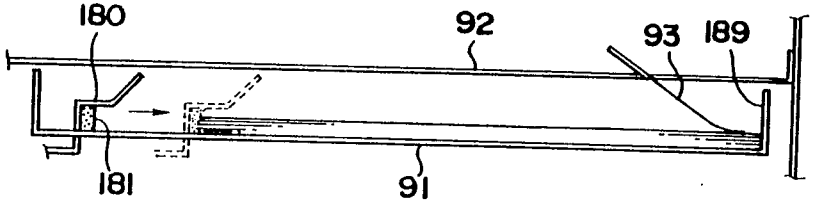
FIG. 16 is an explanatory drawing showing a condition of lateral alignment of sheets on the staple tray.

The side regulating plate 180 is disposed through slots 91*a* of the staple tray 91, having its one end fixed to a support member 182 provided with a rack 182*a* on its one side, and the other end protruding above the staple tray 91. The protruded end of the side regulating plate 180 is provided with a highly frictional and elastic pad 181 made of, for example, sponge material on a surface thereof to be abutted against sheets. The rack 182*a* meshes with a pinion gear 185 of a reversible motor 184 via an intermediating gear 186. The side regulating plate 180 is initially disposed in a position as indicated by a solid line in FIGS. 14 and 15. When the sheets on the staple tray 91 are laterally aligned, the side regulating plate 180 is moved in the direction indicated by an arrow n together with the supporting member 182 by effecting the forward rotary force of the motor 184, and is stopped in a position corresponding to the widths of the sheet in A4 or B5 size. At this time, as shown in FIG. 16, the side of the sheets abutting against te reference guide plate 189 is pushed down by a flexible film 93 provided on the upper guide plate 92. Meanwhile, the other side of the sheets is pushed by the elastic pad 181 of the side regulating plate 180 to thereby laterally align the sheets.

It is noted here that the terminal distance between the side regulating plate 180 and the reference guide plate 189 is made slightly shorter than the width of a corresponding sheet size. This dimensional arrangement is made for the following reason: if the terminal distance between the side regulating plate 180 and the reference plate 189 is made to coincide with the width of the corresponding sheet size, it is difficult to securely align the sheets when they are curled. In other words, with the slight undersize arrangement of the terminal distance between the side regulating plate 180 and the reference plate 189, the sheets are forcedly pressed by the side regulating plate 180 toward the reference guide plate 189 to be securely aligned. Meanwhile, the flexible film 93 provided adjacent to the reference guide plate 189 prevents the corresponding side of the sheets from lifting up.

The elastic pad 181 provided on the side regulating plate 180 effectively absorbs excessive pressure exerted on the sheets at the time of the lateral sheet aligning operation as mentioned before. Furthermore, the elastic pad 181 is frictional enough to securely hold the sheets, therefore, it can align curled sheets without allowing the sheets to lift up.

On the other hand, the home position of the side regulating plate 180, and the terminal positions of it corresponding to A4 size and B5 size are respectively controlled by signals obtained by detecting the position of a projection 183 provided on the supporting member 182 with photosensors Se12, Se14 and Se16.

Figure 13:
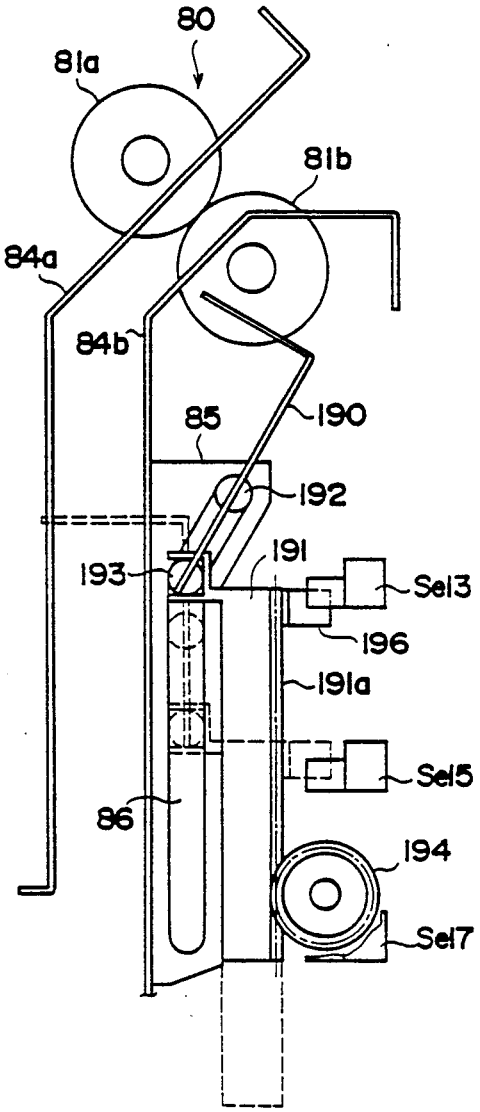
FIG. 13 is an elevational view showing a longitudinal regulating plate arranged on a staple unit.
Figure 14:
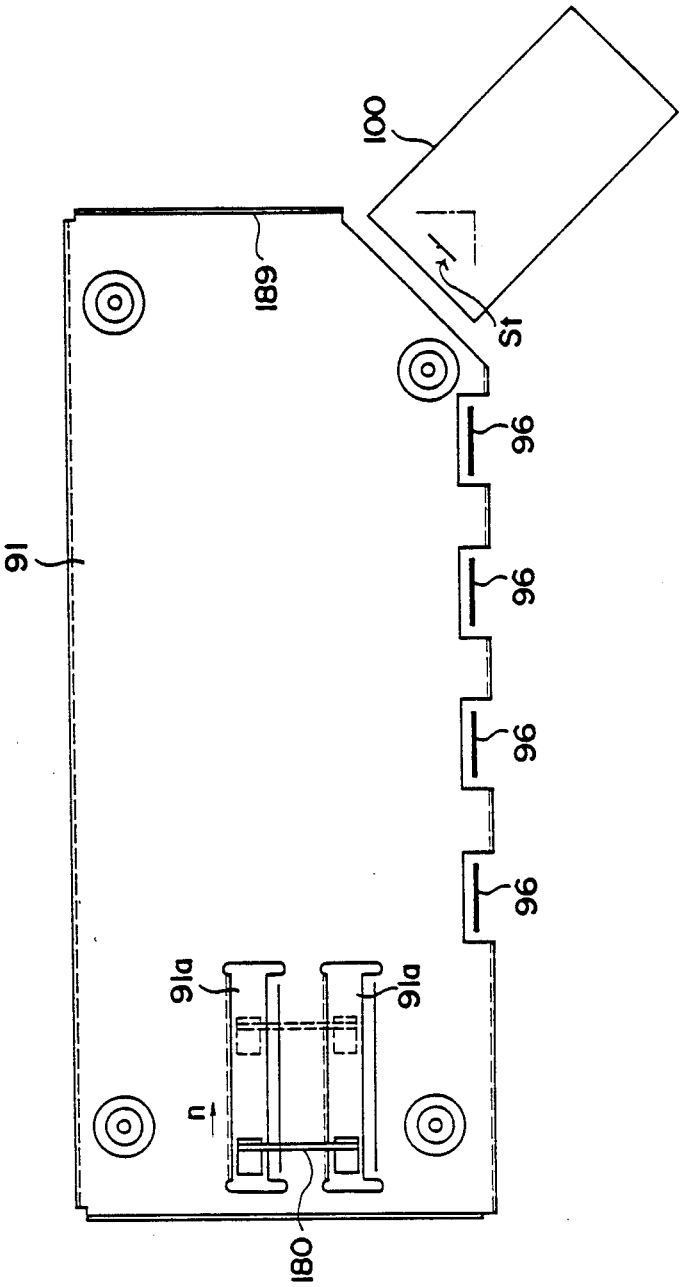
FIG. 14 is a plan view showing a staple tray.
Figure 15:
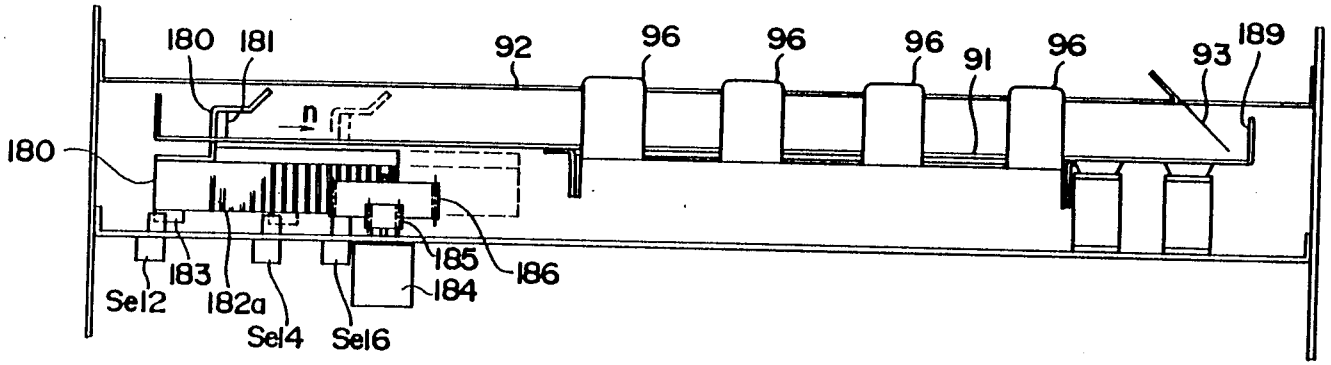
FIG. 15 is an elevational view showing the staple tray.

As shown in FIG. 13, the longitudinal regulating plate 190 is held by a support member 191 by means of pins 192 and 193, where the support member 191 is provided on its one side with a rack 191*a*. The pins 192 and 193 are slightly engaged in a guide slot 86 formed in the frame 85 fixed to the guide plate 84*b*. The rack 191*a* meshes with a pinion gear 194 of an unshown reversible drive motor. The longitudinal regulating plate 190 is initially retracted behind the guide plate 84*b* in a position as indicated by a solid line in FIG. 13 because the pin 192 is positioned in the uppermost angle portion of the guide slot 86. With this configuration, the longitudinal regulating plate 190 does not interfere with the transport of sheets to the staple tray 91. When the sheets is aligned longitudinally, the longitudinal regulating plate 190 slides downward with the support member 191 by effecting the forward rotation of the motor. The longitudinal regulating plate 190 ceases its descending motion at a position corresponding to the length of a sheet in A4 or B5 size as indicated by a dotted line in FIG. 13. Consequently, the upper and lower ends of the sheets are aligned respectively by the longitudinal regulating plate 190 and the stopper 96.

Further, the home position of the longitudinal regulating plate 190 and the terminal positions of it corresponding to A4 size and B5 size are respectively controlled by signals obtained by detecting the position of a projection 196 provided on the supporting member 191 with photosensors Se13, Se14 and Se17.

It should be noted that the side and longitudinal regulating plates 180 and 190 are arranged to move not simultaneously but sequentially. The above arrangement is selected in consideration of the fact that the regulating motions of the plates 180 and 190 resistively interact with each other when the plates 180 and 190 are moved simultaneously.

The stopper 96 is installed on a supporting shaft 97 to serve as a supporting point so that the stopper 96 can be turned by a solenoid not shown in the drawings. The stopper 96 is normally located on the lower end of the staple tray 91 to determine the end position of the sheets. When the solenoid is turned on, the stopper 96 retreats downwards to cancel the sheet positioning.

Figure 17:
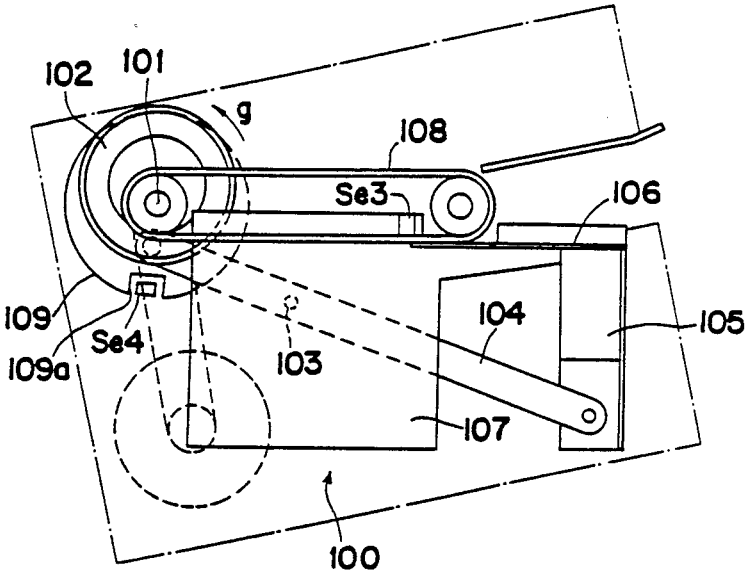
FIG. 17 is a plan view of a stapler.

As shown in FIG. 17, the stapler 100 comprises a fixed output shaft 101 of a motor, an oscillating arm 104 on a pin 103 to serve as a supporting point and a cam 102 whose circumferential part is connected to a head 105 so that the rotation of the cam 102 towards the direction of an arrow g by the motor causes the head 105 to move upward through the arm 104, and a staple 106 binds the sheets trued up on the staple tray 91. The staples 106 are contained in a cartridge 107 and transported to the head 105 by a conveyor belt 108 which is driven to turn by the output shaft 101 of the motor.

The stapler 100 is provided with a photosensor Se3 for detecting the absence of the staples 106 and a photosensor Se4 for detecting the number of revolutions of the staple motor so that the sensor Se3 directly detects the staples 106, while the sensor Se4 detects a notch 109*a* of a disk 109 fixed to the output shaft 101 of the motor.

Furthermore, the stapling unit 90 is provided with a photosensor Se6 for detecting the presence and absence of the sheets on the staple tray 91 and a switch SW4 for detecting the mounting and dismounting of the stapler 100.

In the above-described arrangement, the sheets transported from the transport unit 80 to the staple tray 91 are laterally and longitudinally aligned by being pressed by the regulating plates 180 and 190 respectively toward the reference guide plate 189 and the stopper 96. The trued up sheets are bound at a position indicated by an arrow St in FIG. 14 by the rotation of the staple motor. When the solenoid is turned on to withdraw the stopper 96 from the tray 91, the stapled sheets slide down onto a stack tray 111 by being guided by a plate 98. Such stapling operation is repeated each time when the sheets in the bins 60 are carried onto the staple tray 91.

The absence of the staples 106 is not necessarily required to be detected only by the sensor Se3. That is, at the time of the stapling operation, the absence of the staples 106 can also be detected by the sensor Se4, since the number of revolutions of the staple motor increases when the torque needed for rotating the cam 102 has decreased due to the absence of the staples 106. Thus, the increase in the number of revolutions of the staple motor indicates the absence of the staples 106.

(Construction of stack unit)

Figure 18:
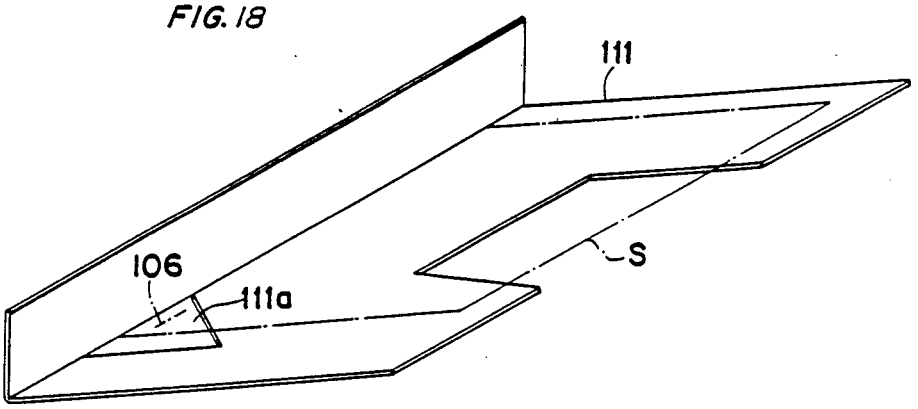
FIG. 18 is a perspective view of a stack tray.

The stack unit 110 comprises the stack tray 111 which is designed for finally containing the sheets stapled by the stapler 100. As shown in FIG. 18, the stack tray 111 has a notch 111*a* in its part to be used for the stapling of the sheet S, that is, the part where the part of the sheet stapled with the staple 106 is located so that the sheet stapled with the stapler 100 and placed on the tray 111 hangs down into the notch 111*a* by its own weight, whereby not only the stapled parts of sheets can be prevented from becoming higher than the non-stapled parts when they are stacked but also the stacking capacity of the stack tray 111 can be increased.

Figure 19:
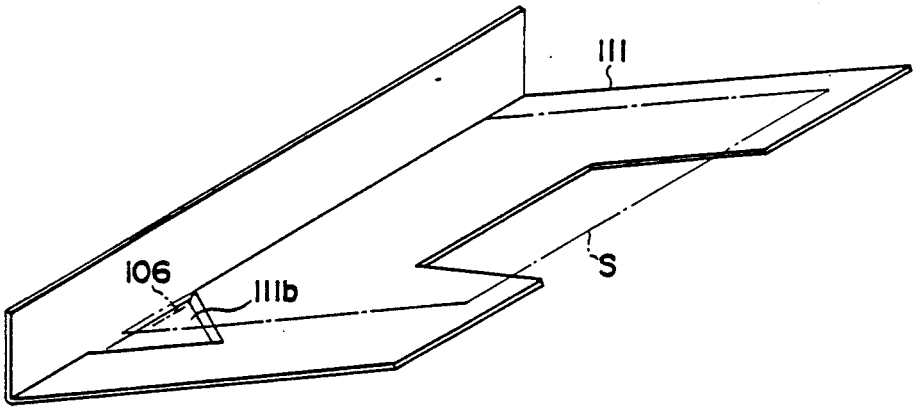
FIG. 19 is a perspective view showing another example of a stack tray.

The similar effect can also be achieved when an indent 111*b* is formed in the part of the stack tray 111 where the parts of the sheets stapled with staples 106 are stacked as shown in FIG. 19.

(Operation panels)

Figure 20:
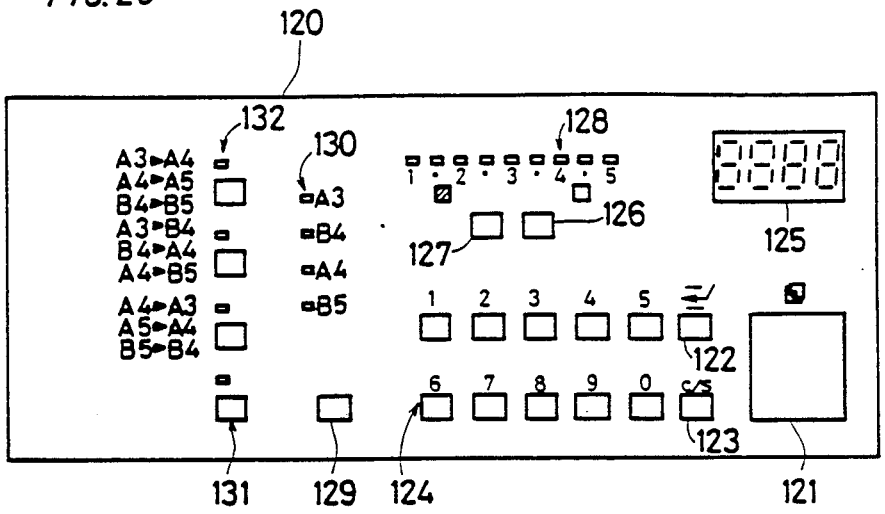
FIG. 20 is a plan view showing an operation panel of the copying machine.
Figure 21:
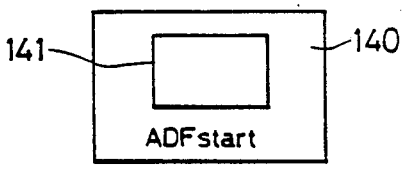
FIG. 21 is a plan view showing an operation panel of an ADF.
Figure 22:
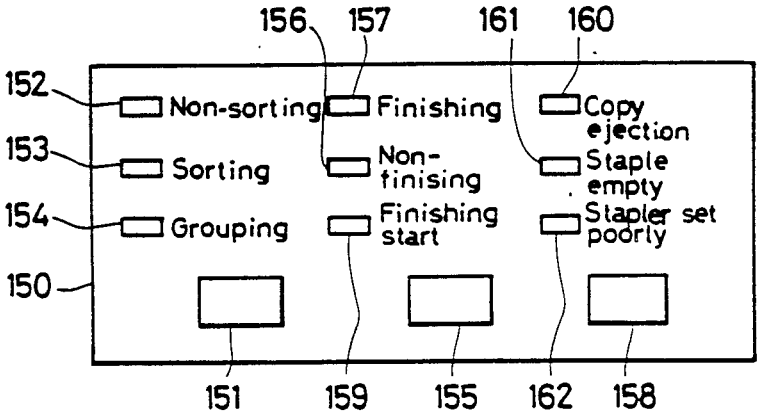
FIG. 22 is a plan view showing an operation panel of the sorter-finisher.

In this embodiment, operation panels are installed at the three places in a copying machine panel 120, an ADF panel 140 and a sorter panel 150 as shown in FIGS. 20, 21 and 22 respectively.

Installed on the copying machine panel 120 are a print key 121 for starting the copying operation when ADF 30 is not used, an interruption key 122 for interrupting the multicopying operation temporarily, a clear/stop key 123 for stopping the copying operation or canceling the input number of copy sets, ten key group 124 for setting the number of copy sets, an indicator 125 for indicating the number of copy sets and the condition of the copying machine 1, up/down keys 126 and 127 for setting the density for copy image, LEDs 128 for indicating the density for copy image, a sheet selection key 129 for selecting the sheet size, LEDs 130 for indicating said sizes, magnification selection key group 131 for selecting the copying magnification and LED group 132 for indicating said magnifications.

Installed on the ADF panel 140 is only a start key 141 for starting the ADF 30. When this start key 141 is turned on, the documents on the document tray 31 are automatically transported one by one onto the glass 29 of the document rest, and the copying operation is started.

Installed on the shorter panel 150 are a sorter mode selection key 151, non-sorting mode indication LED 152, sorting mode indication LED 153 and grouping mode indication LED 154 which are the indicators of the sorter mode selection key 151, finishing mode selection key 155, non-finishing mode indication LED 156 and finishing mode indication LED 157 which are the indicators of the finishing mode selection key 155, finishing start key 158 and LED 159 as the indicator for the finishing start key 158. The LED 159, when lighted, indicates that the finishing operation is in progress, and, when is flicking, alarms for the necessity of removing the sheets from the staple tray 91. An LED 160 alarms for requiring the necessity of removing the sheets from bins 60, an LED 161 alarms for indicating that the staples 106 are absent and an LED 162 alarms for indicating the poor setting of stapler 100.

The sorter mode selection key 151 selects the modes in the order of non-sorting mode, sorting mode and grouping mode when the key 151 is depressed in succession, and the corresponding LEDs 152, 153 and 154 are lighted accordingly. The finishing mode selection key 155 also selects the modes in the order of non-finishing mode and finishing mode when the key 155 is depressed in succession, and the corresponding LEDs 156 and 157 are lighted accordingly. The finishing start key 158 outputs the signals in the order of the signal for the start of finishing operation and the signal for its cancellation when the key 158 is depressed in succession, and the LED 159 lights when the key 158 is depressed for the start of finishing operation.

(Control circuit)

Figure 23:
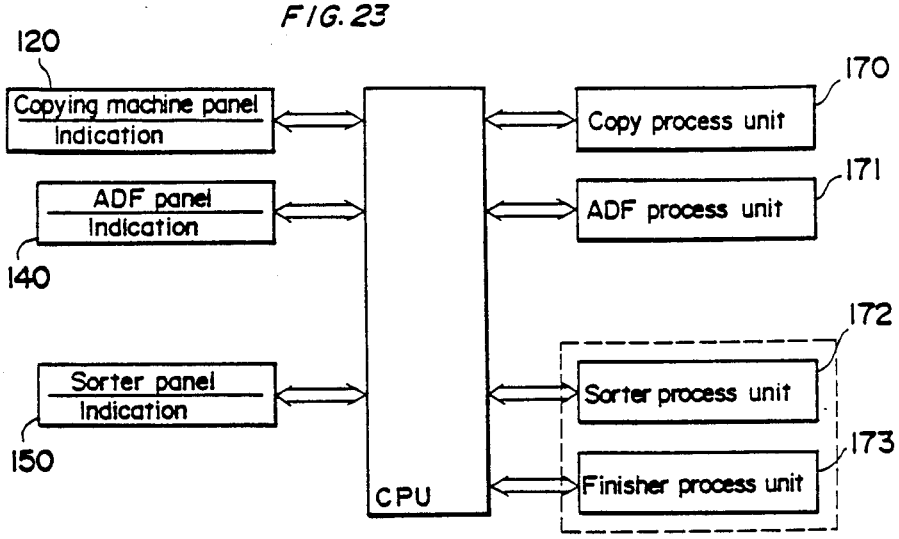
FIG. 23 is a block diagram showing a control circuit.

FIG. 23 is a block diagram of the control circuit wherein a microcomputer is connected to the copying machine panel 120, ADF panel 140, sorter panel 150, copy processing unit 170, ADF processing unit 171, sorter processing unit 172 and finisher processing unit 173 so that the signals can be exchanged with each other.

Figure 24:
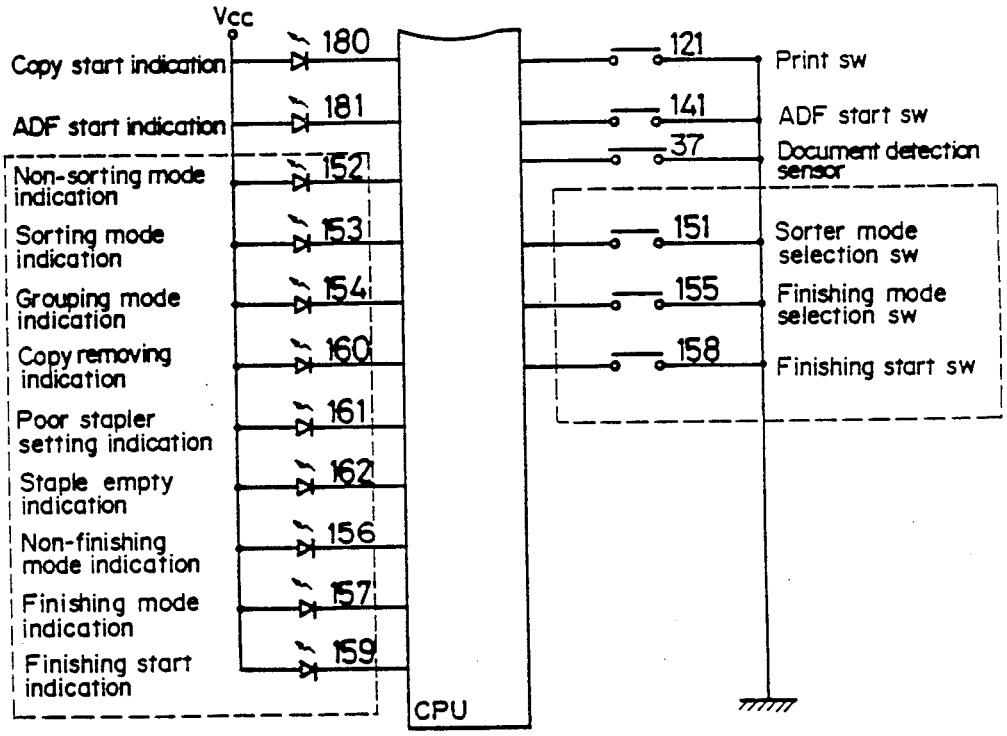
FIG. 24 is details of the control circuit.

FIG. 24 shows the essential part of the control circuit wherein the input/output port of the microcomputer is connected to the print switch, ADF switch and their built-in indicator LEDs 180 and 181, various selection switches of the sorter panel 150, various indicator LEDs.

(Control Procedure)

Here, the control procedures of the copying machine 1 and the sorter-finisher 40 based on the control circuit will be explained in reference to FIG. 25 and on.

In the following paragraphs, the term "on-edge" is defined as change in status, where the switch, sensor, signal or the like changes from the off status to the on status. In contrast, the term "off-edge" represents change in status, where the switch, sensor, signal or the like changes from the on status to the off status.

Figure 25:
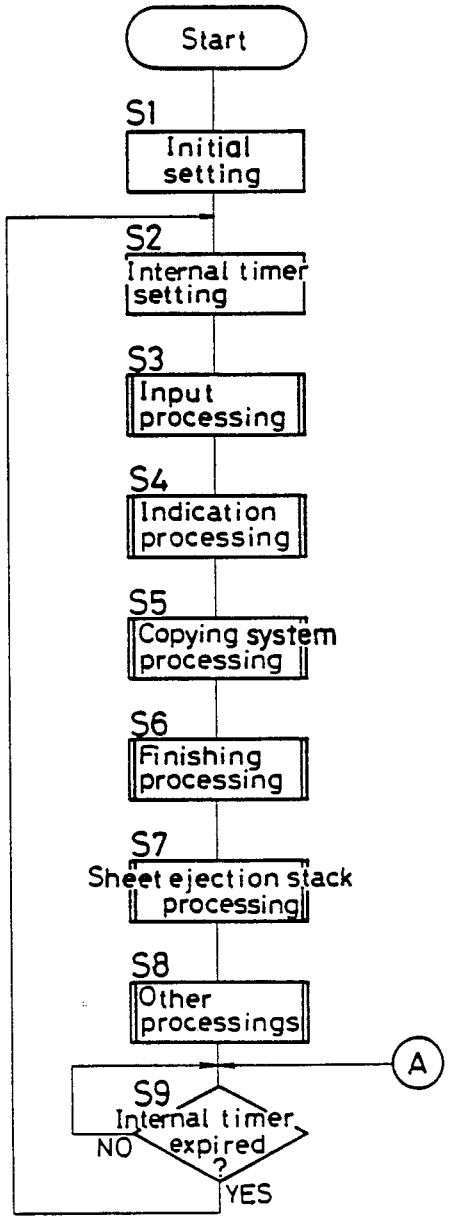
FIG. 25 is a flow chart showing a main routine of a CPU.

FIG. 25 shows a main routine of the microcomputer.

When the microcomputer is reset, and the program is started, the clearance of random access memory at step S1 and initialization (or setting for initial mode) of various registers and units take place. An internal timer starts at step S2. The internal timer is for setting the time required for the execution of the main routine, which is to be set in advance at the time of initialization at step S1.

Various subroutines, which will be explained later, are called one by one at steps S3 through S8. When the execution of all the subroutines are completed, the processing returns to step S2 after the time set by the internal timer has passed at step S9. The length of time required for one routine is used in making various counting with various counters during the execution of the subroutines.

Figure 26A:
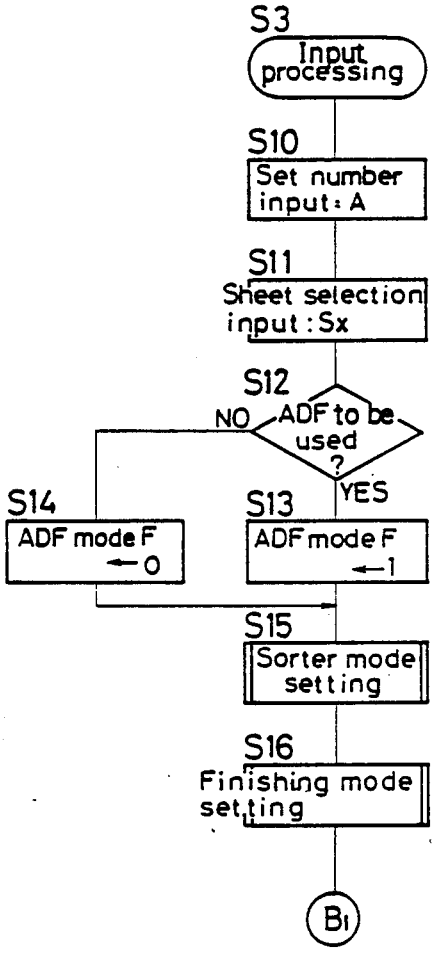
FIGS. 26*a*, 26*b* and 26*c* are flow charts showing a subroutine for the input processing.
Figure 26B:
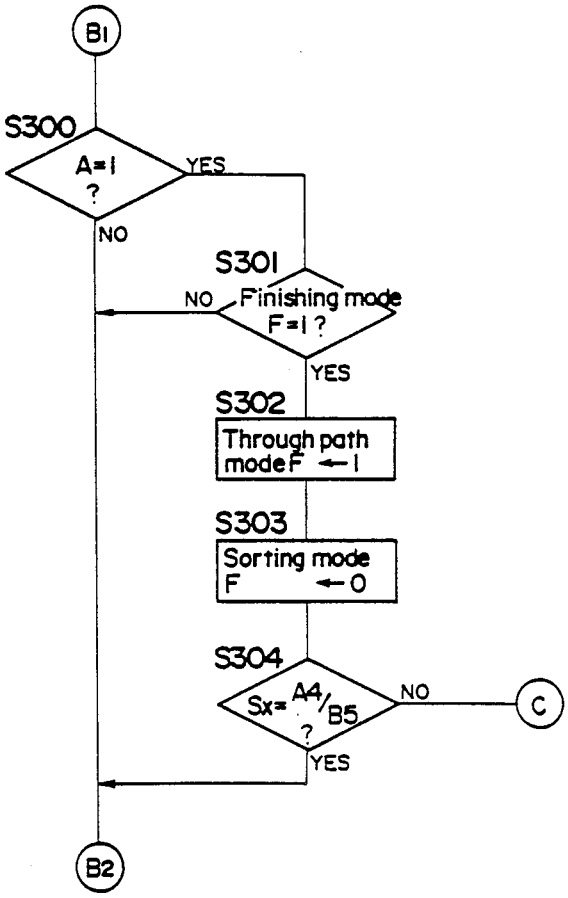
Figure 26C:
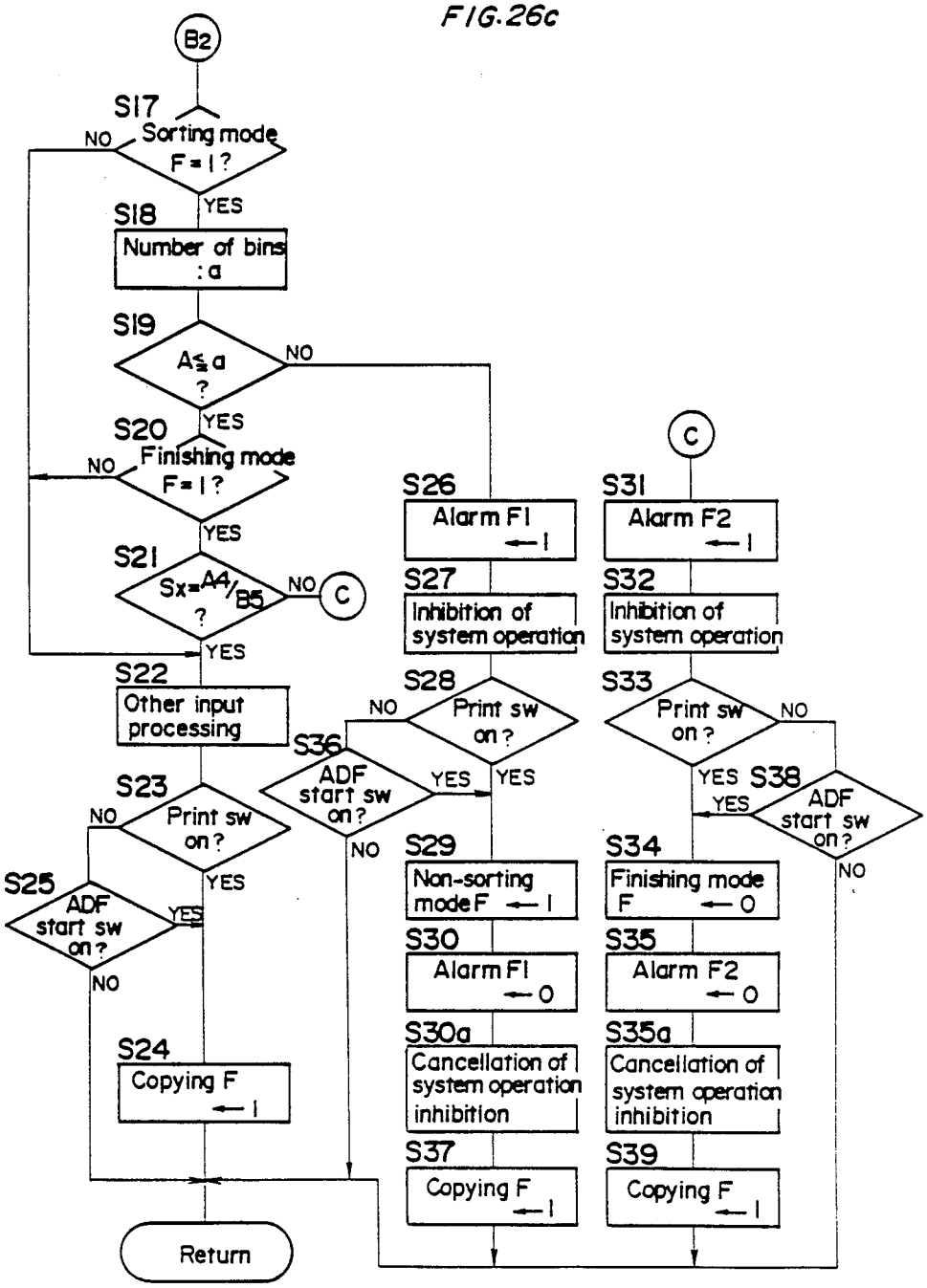

FIGS. 26*a*, 26*b* and 26*c* show a subroutine for the input processing to be executed at step S3 of the main routine.

First, a set number (A) is inputted by the ten key group 124 on the copying machine panel 120 at step S10. Then, the sheet size (Sx) selected is inputted at step S11, and whether the ADF 30 has been selected for use is checked at step S12. When the ADF 30 has been selected for use, an ADF mode flag is set to "1" at step S13, and, when not selected, the ADF mode flag is reset to "0" at step S14.

A subroutine for setting sorter mode is executed at step S15. A subroutine for setting finishing mode is executed at step S16, and whether the set number (A) input for copy sets is "1" or not is checked at step S300. When the set number (A) is not "1", the processing goes to step S17 at once, when the set number (A) is "1", whether a finishing mode flag is "1" or not is checked at step S301. When the flag is "0", the processing goes to step S17. When the flag is "1", that is, if the set number (A) is input at "1" and if the finishing mode for executing the stapling operation is selected, a through path mode flag is set to "1" at step S302, a sorting mode flag is reset to "0" at step S303.

Next, at step S304, whether the sheet size (Sx) is A4 size or B5 size is checked. In this embodiment, the sheet sizes allowed for the stapling operation are A4 size and B5 size. Then, when the result is "Yes", the processing goes to step S17, when the result is "No", the processing goes to step S31.

At step S17, whether the sorting mode flag is "1" or not is checked. When the sorting mode flag is "0", the sorting and stapling operations will not be executed, so that the processing goes to step S22. When the sorting mode flag is "1", the bin number (a) is inputted at step S18, and the set number (A) and the bin number (a) are compared at step S19. When the set number (A) is less than the bin number (a), the operation in the sorting mode is possible, whether the finishing mode flag is "1" or not is checked at step S20. When the finishing mode flag is "0", the processing goes to step S22, and, when is "1", whether the sheet size (Sx) is A4 size or B5 size is checked at step S21. As above-described, the sheet sizes allowed for stapling operation are A4 size and B5 size. When the result is "Yes", other input processing is executed at step S22 and, when the result is "No", the processing goes to step S31.

Further, whether the print switch 121 is turned on or not is checked at step S23. When turned on, a copying flag is set to "1" at step S24 for enabling the copying operation. When not on, whether the ADF start switch 141 is turned on or not is checked at step S25. When turned on, the processing at said step S24 is executed, and, when not on, the subroutine is terminated.

On the other hand, the set number (A) is judged to be larger than the bin number (a) at said step S19, an alarm flag F1 is set to "1" at step S26, and the operation of the system is inhibited at step S27. The alarm flag F1 is for the indication at the time when the number for distribution has exceeded the number of the bins 60. At steps S28 and S36, whether the print switch 121 and the ADF start switch 141 are turned on respectively are checked in the same manner as that at said steps S23 and S25. When the result is "Yes", or the operator's will for executing the copying operation regardless of the alarm signal, a non-sorting mode flag is set to "1" at step S29, and the alarm flag F1 is reset to "0" at step S30. Then, the inhibition of system operation is canceled at step S30*a*, and the copying flag is set to "1" at step S37.

Further, when the sheet size (Sx) is judged to be other than A4 size and B5 size at said steps S21 and S304, the stapling operation is not possible, so that an alarm flag F2 is set to "1" at step S31, and the operation of the system is inhibited at step S32. The alarm flag F2 is for indicating that the selected sheet size is wrong. Then, whether the print switch 121 and the ADF start switch 141 are turned on respectively are checked at steps S33 and S38 in the same manner as that at said steps S23 and S25. When the operator's will for executing the copying operation regardless of the alarm signal at step S33 or step S38 is confirmed, the finishing mode flag is reset to "0" at step S34, and the alarm flag F2 is reset to "0" at step S35. The inhibition of the system operation is canceled at step S35*a*, and the copying flag is set to "1" at step S39.

Figure 27:
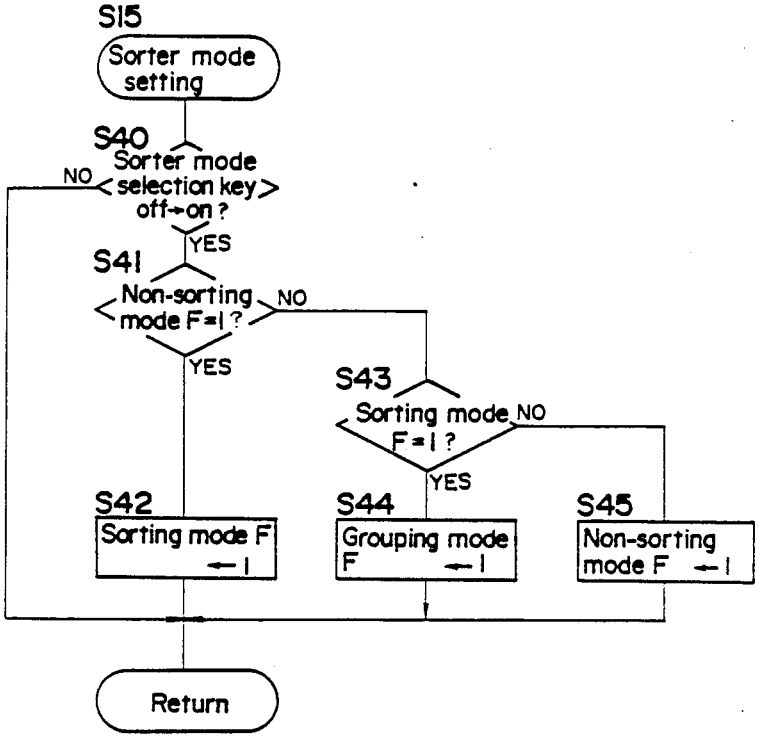
FIG. 27 is a flow chart showing a subroutine for the sorter mode setting.

FIG. 27 shows a subroutine for the sorter mode setting to be executed at said step S15.

In the subroutine, whether or not the sorter mode selection key 151 is changed to on from off is checked at step S40. When the result is "No", the subroutine is terminated at once. When the result is "Yes", at steps S41 and S43, whether or not the non-sorting mode flag and the sorting mode flag are "1" are checked respectively. When the non-sorting mode flag is "1", the sorting mode flag is set to "1" at step S42. When the sorting mode flag is "1", a grouping mode flag is set to "1" at step S44. When both the non-sorting mode flag and the sorting mode flag are "0", or at this time the grouping mode flag is "1", the non-sorting mode flag is set to "1" at step S45.

Figure 28:
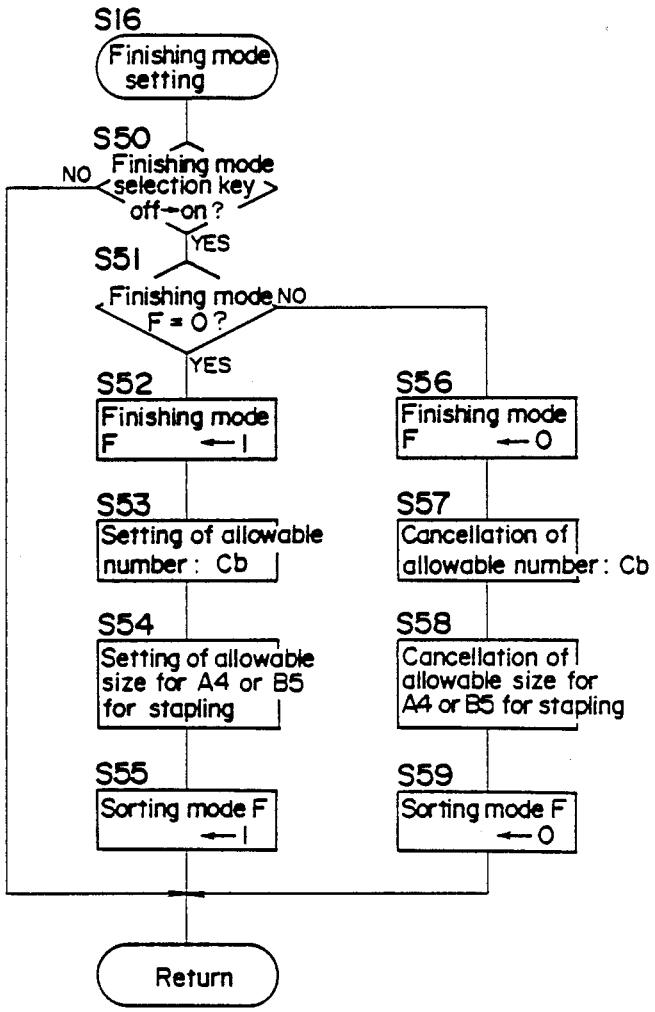
FIG. 28 is a flow chart showing a subroutine for the finishing mode setting.
Figure 29A:
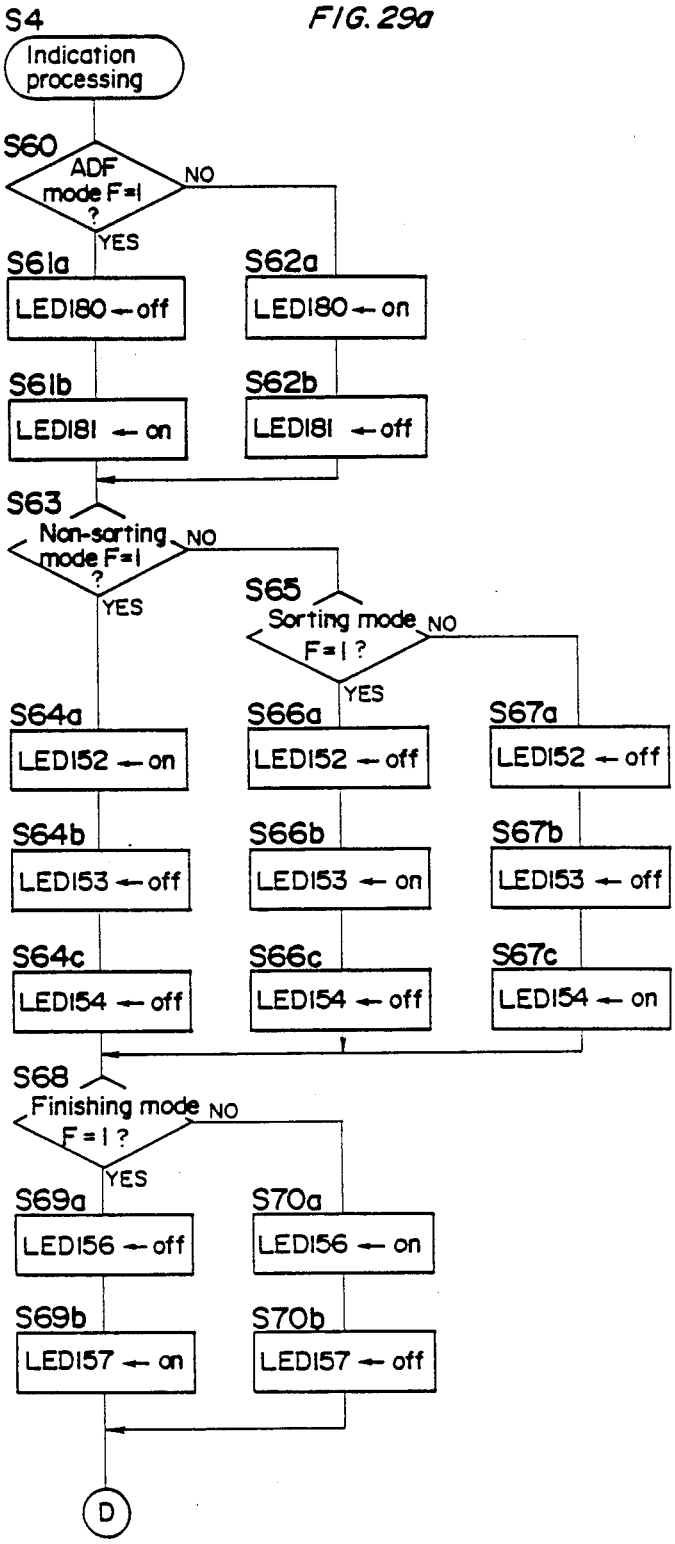
FIGS. 29*a*, 29*b*, 29*c* and 29*d* are flow charts showing a subroutine for the indication processing.
Figure 29B:
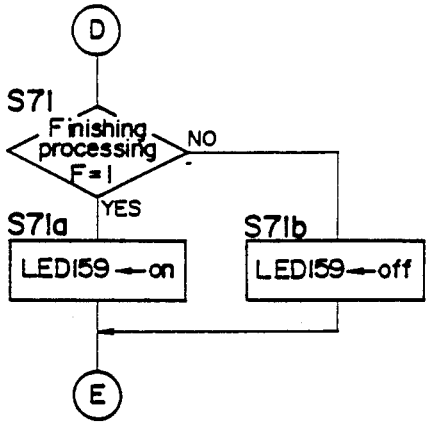
Figure 29C:
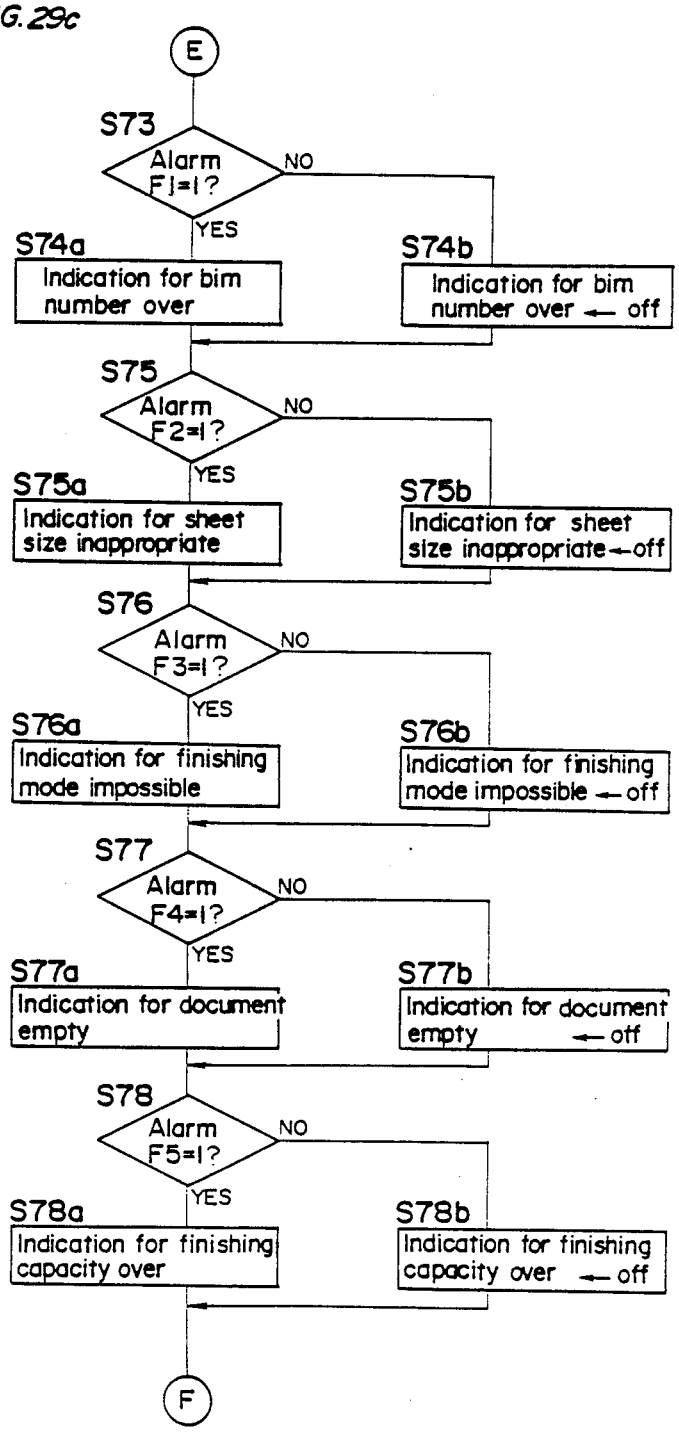
Figure 29D:
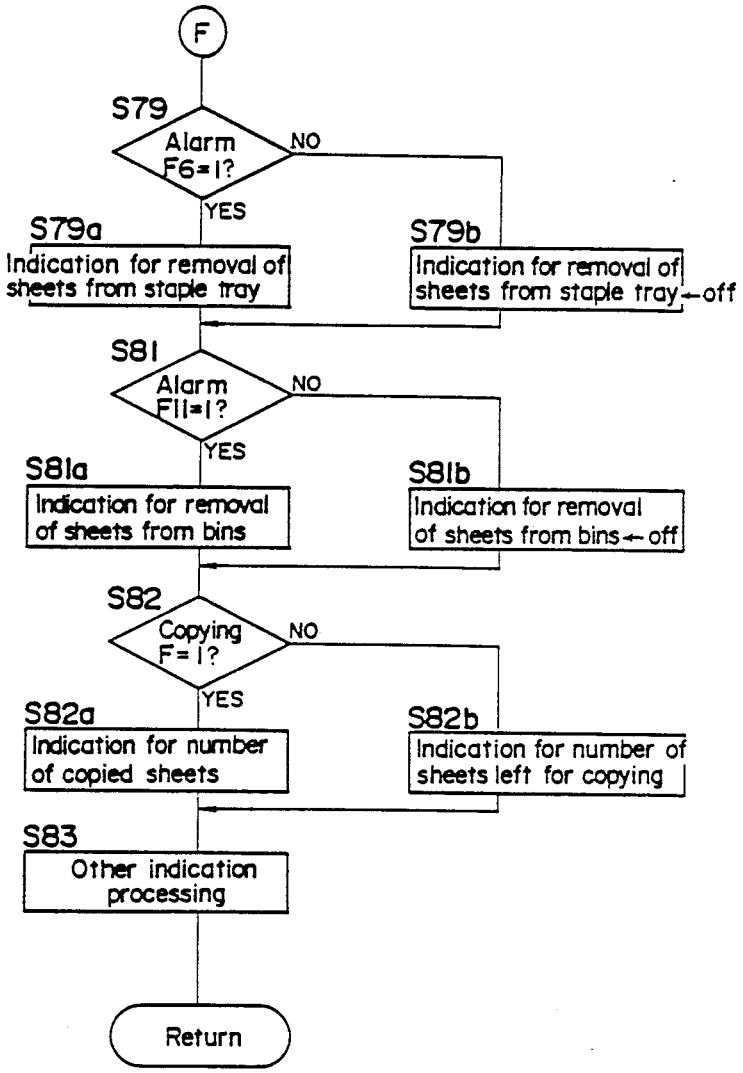

FIG. 28 shows a subroutine for the finishing mode setting to be executed at said step S16.

First, whether or not the finishing mode selection key 155 is changed to on from off is checked at step S50. When the result is "No", the subroutine is terminated at once. When the result is "Yes", at step S51, whether or not the finishing mode flag is "0" is checked. When the flag is "0", so the finishing mode has not been selected, the finishing mode flag is set to "1" step S52. Then, allowable stapling number (Cb) is set at step S53. The allowable sheet size for stapling is set to A4 and B5 at step S54. The sorting mode flag is set to "1" at step S55 for allowing the operation in the sorting mode.

On the other hand, at said step S51, when the finishing mode flag is judged to be "1", so the finishing mode has been selected, the finishing mode flag is reset to "0" at step S56. Then, the allowable stapling number (Cb) is canceled at step S57. The allowable sheet size for stapling is canceled at step S58. The sorting mode flag is reset to "0" at step S59, the operation in the sorting mode is inhibited.

FIGS. 29*a* through 29*d* show a subroutine for the indication processing to be executed at step S4 of the main routine.

First, whether the ADF mode flag is "1" or not is checked at step S60. When is "1", the LED 180 for indicating the non-ADF mode is turned off at step S61*a*, the LED 181 for indicating the ADF mode is turned on at step S61*b*. When the ADF mode flag is "0", the LED 180 is turned on at step S62*a*, the LED 181 is turned off at step S62*b*.

Further, whether the non-sorting mode flag and the sorting mode flag are "1" or not are checked at steps S63 and S65 respectively. When the non-sorting mode flag is "1", the LED 152 for indicating the non-sorting mode is turned on at step S64*a*, the LEDs 153 and 154 are turned off at steps S64*b* and S64*c*. when the sorting mode flag is "1", the LED 152 is turned off at step S66*a*, the LED 153 for indicating the sorting mode is turned on at step S66*b*, the LED 154 is turned off at step S66*c*. When said two flags are "0", the LEDs 152 and 153 are turned off at steps S67*a* and S67*b*, the LED 154 for indicating the grouping mode is turned on at step S67*c*.

Next, at step S68, whether the finishing mode flag is "1" or not is checked. When is "1", the LED 156 for indicating the non-finishing mode is turned off at step S69*a*, the LED 157 for indicating the finishing mode is turned on at step S69*b*. When the finishing mode flag is "0", the LED 156 is turned on at step S70*a*, the LED 157 is turned off at step S70*b*. At step S71, whether the finishing processing flag is "1" or not is checked. When is "1", the LED 159 for indicating the finishing processing has started is turned on at step S71*a*. When is "0", the LED 159 is turned off at step S71*b*.

Further, at step S73, the alarm flag F1 is checked as to whether is "1" or not. When the flag F1 is "1", the indicator 125 indicates that the number of bins 60 is over at step S74*a*. When the flag F1 is "0", the indication for bin number over the indicator 125 is turned off at step S74*b*. At step S75, the alarm flag F2 is checked as to whether is "1" or not. When the flag F2 is "1", the indicator 125 indicates that the sheet size is inappropriate at step S75*a*. When the flag F2 is "0", the indication for sheet size inappropriate on the indicator 125 is turned off at step S75*b*. At step S76, the alarm flag F3 is checked as to whether is "1" or not. When the flag F3 is "1", the indicator 125 indicates that the finishing mode is impossible at step S76*a*. When the flag F3 is "0", the indication for finishing mode impossible on the indicator 125 is turned off at step S76*b*. At step S77, the alarm flag F4 is checked as to whether is "1" or not. When the flag F4 is "1", the indicator 125 indicates that the document is absent at step S77*a*. When the flag F4 is "0", the indication for document empty on the indicator 125 is turned off at step S77*b*. At step S78, the alarm flag F5 is checked as to whether is "1" or not. when the flag F5 is "1", the indicator 125 indicates that the finishing capacity is over at step S78*a*. When the flag F5 is "0", the indication for finishing capacity over on the indicator 125 is turned off at step S78*b*. At step S79, the alarm flag F6 is checked as to whether is "1" or not. When the flag F6 is "1", the LED 159 is flickering at step S79*a*, indicates that the sheets need to be removed from the staple tray 91. When the flag F6 is "0", the LED 159 is turned off, so the indication for removal of the sheets from the staple tray 91 is turned off at step S79*b*. At step S81, the alarm flag F11 is checked as to whether is "1" or not. When the flag F11 is "1", the LED 160 is turned on at step S81*a*, indicates that the sheets need to be removed from the bins 60. When the flag F11 is "0", the LED 160 is turned off, so the indication for removal of the sheets from the bins 60 is turned off at step S81*b*.

Further, whether the copying flag is "1" or not is checked at step S82. The indicator 125 indicates the number of copied sheets or the number of sheets left for copying at step S82*a* when the copying flag is "1", and at step S82*b* when it is "0". Subsequently, other indication processing are executed at step S83 so that this subroutine can be completed.

Figure 30:
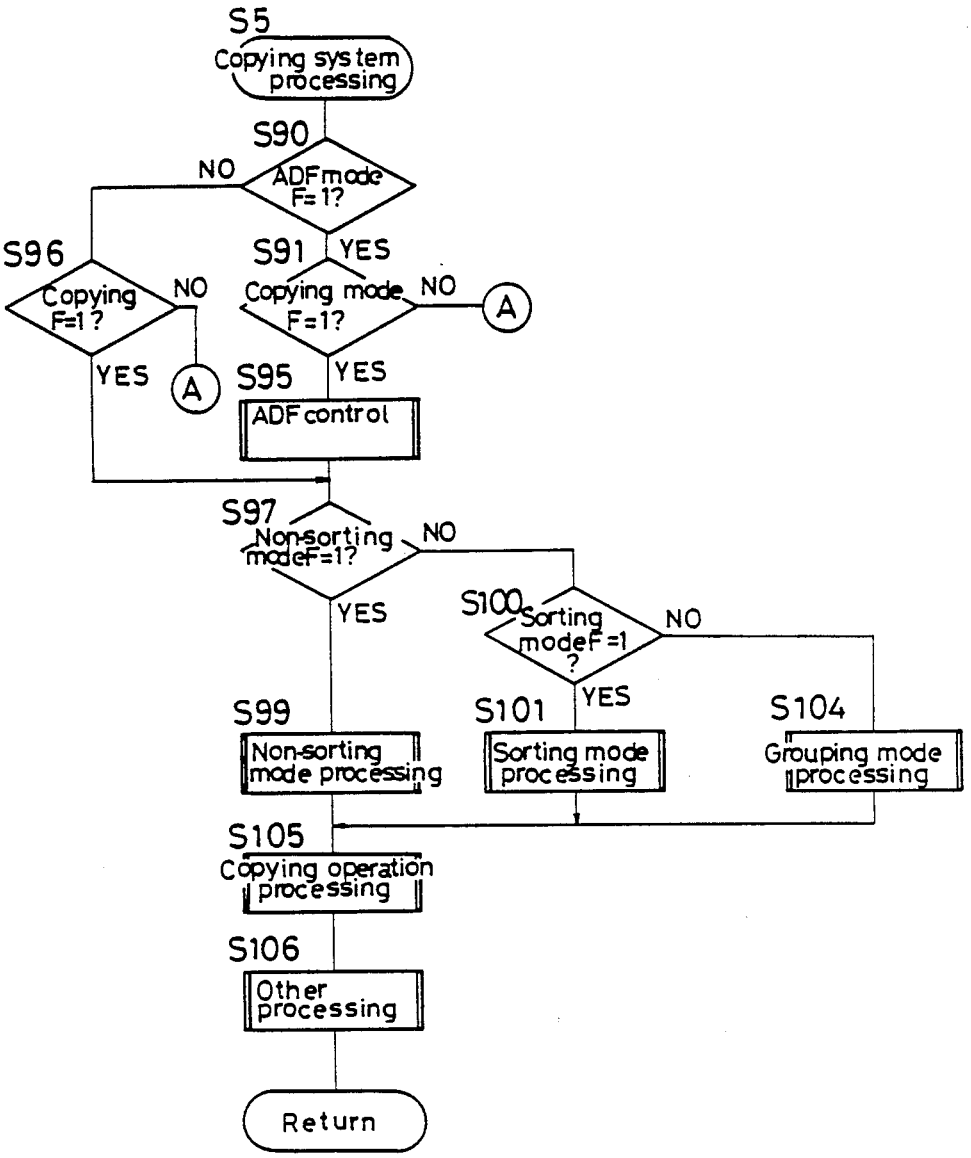
FIG. 30 is a fow chart showing a subroutine for the copying system processing.

FIG. 30 shows a subroutine for the processing of copying system to be executed at step S5 of the main routine.

First, whether the ADF mode flag is "1" or not is checked at step S90. When is "1", whether the copying flag is "1" or not is checked at step S91. Since the copying operation is allowed when the copying flag is "1", a subroutine for the control of the ADF 30 is executed at step S95, and the processing goes to step S97. When the ADF mode flag is judged to be "0" at said step S90, whether the copying flag is "1" or not is checked at step S96. When is "1", the processing goes to step S97. When the copying flag is judged to be "0" at said steps S91 and S96 respectively, the processing returns to the main routine.

When the non-sorting mode flag and the sorting mode flag are verified to be "1" at steps S97 and S100 respectively, subroutines for the non-sorting mode processing and sorting mode processing can be executed at steps S99 and S101 respectively.

On the other hand, when the non-sorting mode flag and the sorting mode flag are verified to be "0" at said steps S97 and S100, a subroutine for the grouping mode processing can be executed at step S104.

Further, a subroutine for the copying operation is executed at step S105, and a subroutine for other processing is executed at step S106.

The subroutines to be executed at said steps S99 and S104 can be executed by the procedures similar to the conventional ones, so that the details of these procedures are omitted here.

Figure 31:
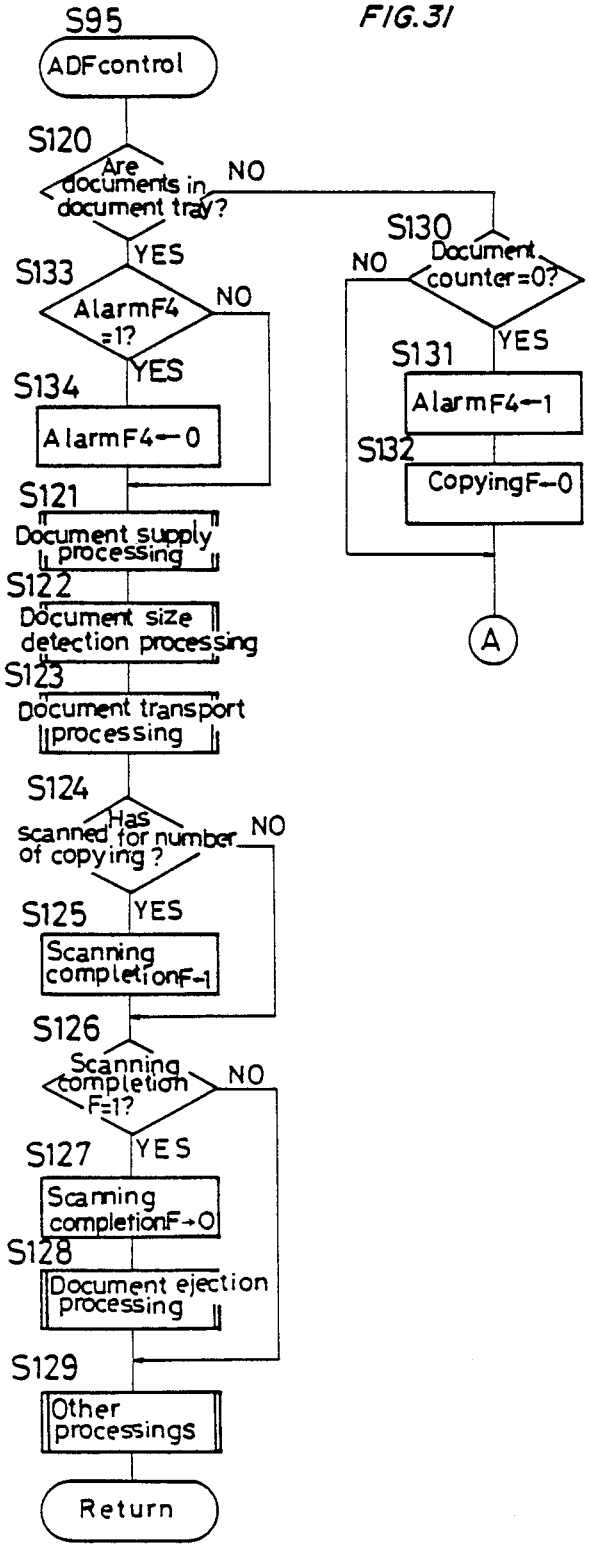
FIG. 31 is a flow chart showing a subroutine for the ADF control.
Figure 32A:
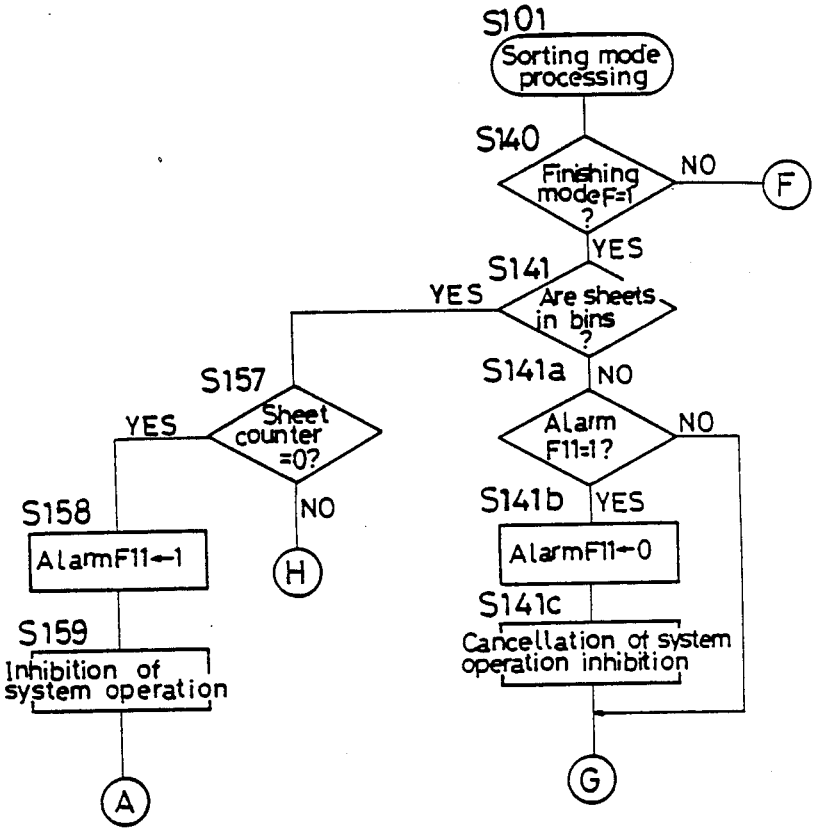
FIGS. 32*a*, 32*b*, 32*c* and 32*d* are flow charts showing a subroutine for the sorting mode processing.
Figure 32B:
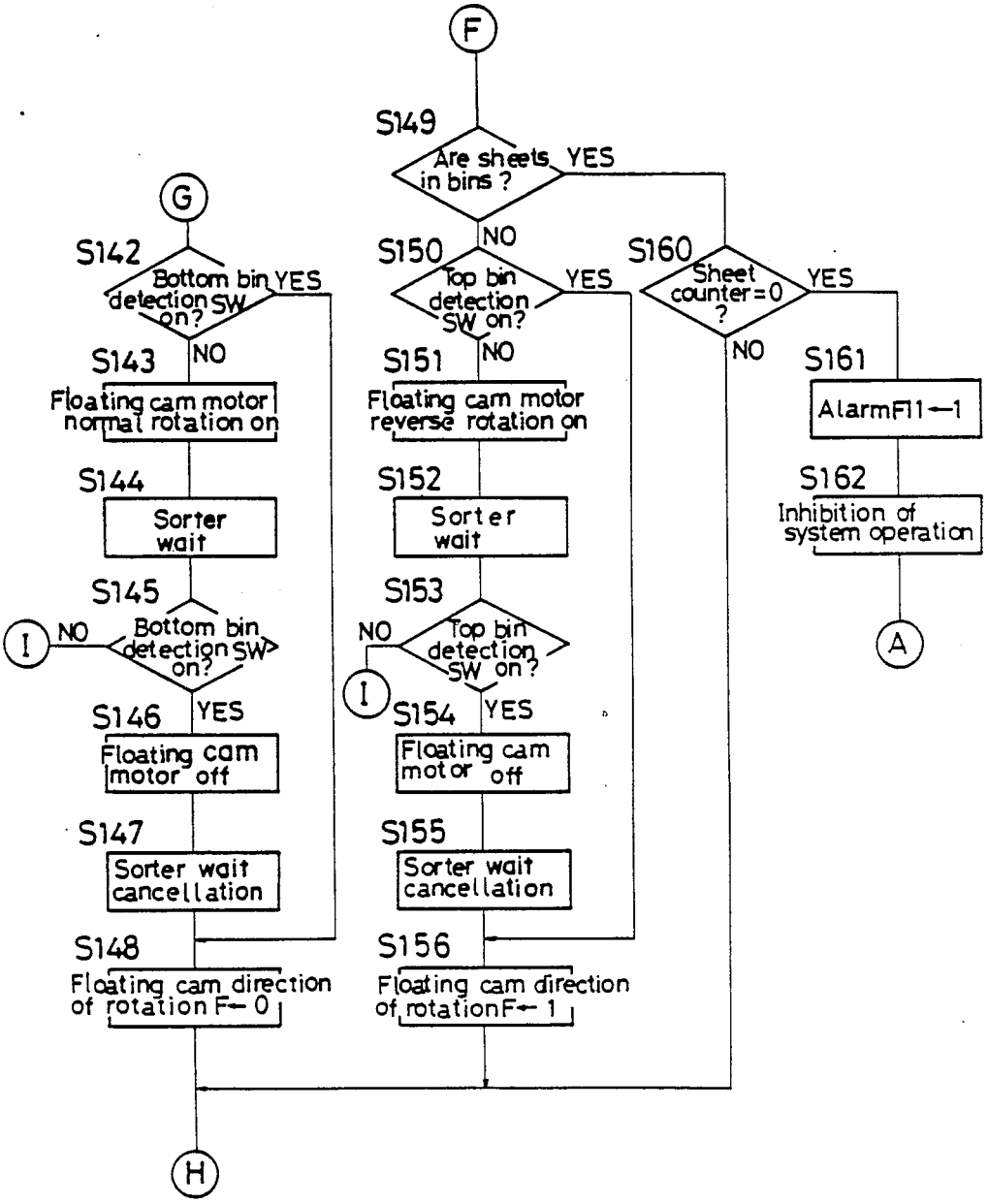
Figure 32C:
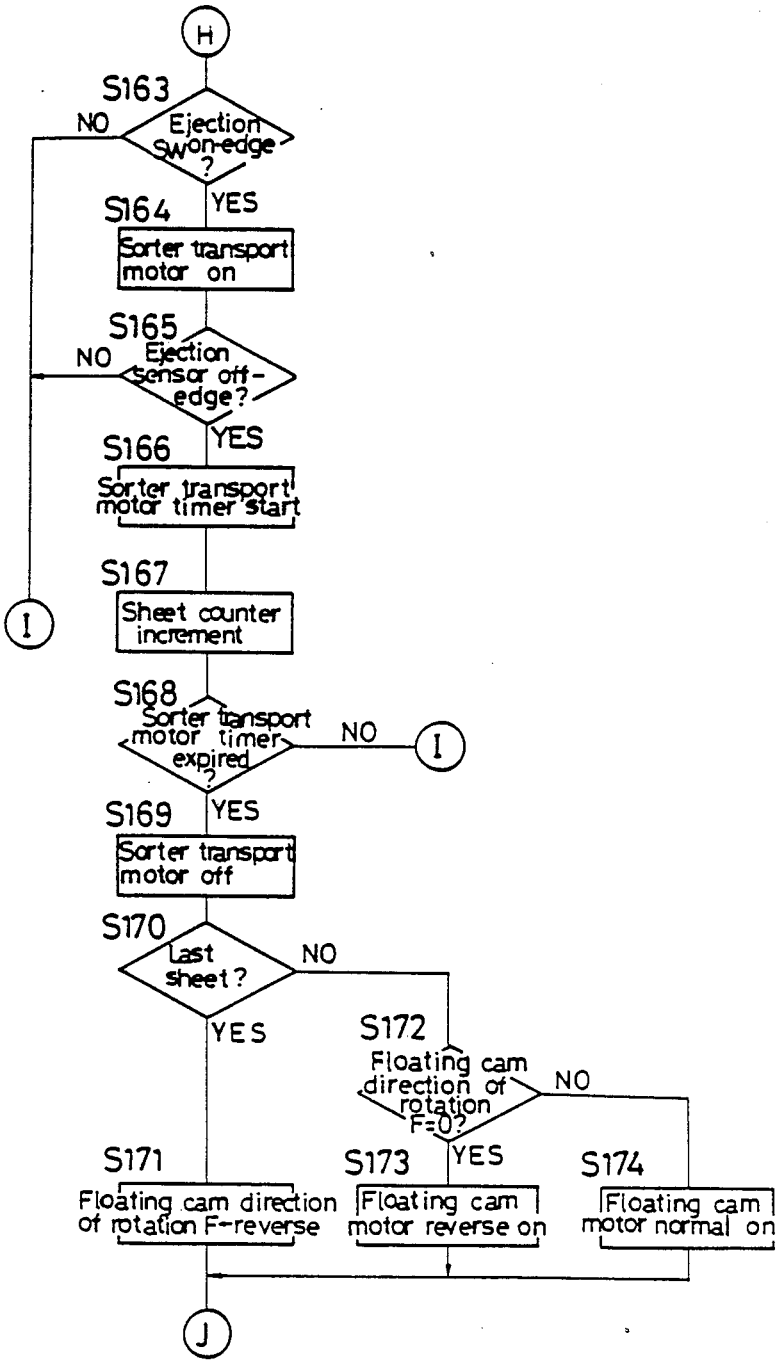
Figure 32D:
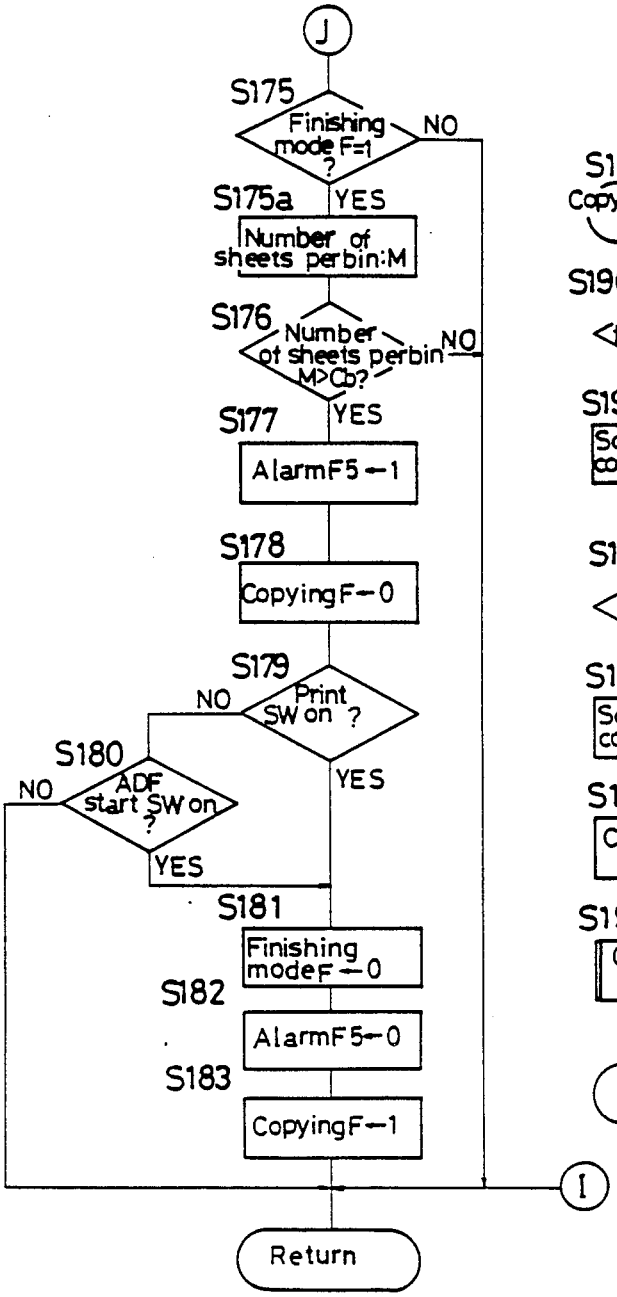

FIG. 31 shows a subroutine for the ADF control to be executed at said step S95.

First, whether the documents are present in document tray 31 or not is checked by on-off action of the sensor 37 at step S120. When the documents are present, whether the alarm flag F4 is "1" or not is checked at step S133. This flag F4 is set to "1" at step S131 which will be explained later, but, when the flag F4 is "1", it is reset to "0" at step S134. Then, document supply processing subroutine at step S121, document size detection processing subroutine at step S122 and document transport processing subroutine at step S123 are executed respectively.

On the other hand, when the documents have run out, whether the document counter registers "0" or not is checked at step S130. When "0" is registered, the alarm flag F4 is set to "1" at step S131, the copying flag is reset to "0" at step S132, and the processing returns to the main routine.

On the other hand, at step S124, whether the optical system 4 has scanned each copy for several minutes or not is checked. When the result is "Yes", a scanning completion flag is set to "1" at step S125. Then, that the scanning completion flag is set to "1" is confirmed at step S126. The scanning completion flag is reset to "0" at step S127. Document ejection processing subroutine is executed at step S128. Subroutines for other processings are executed at step S129.

Further, the ADF control subroutine is similar to the conventional one, so that the details of the subroutines to be executed at said steps S121, S123 and S128 are omitted here.

FIGS. 32*a* through 32*d* show a subroutine for the processing of sorting mode to be executed at said step S101. The subroutine differentiate the action of sorter bins 60 depending on whether the finishing mode is seleted or not. This is because the order of distributing sheets to the bins 60 corresponds to the order of taking-out the sheets from each of the bins 60, and such order are dependent on whether the finishing mode is selected or not. When the finishing mode is selected, the sheets are distributed first to the bottom bin 60 so that the sheet can readily be transported to the stapling unit 90, and when not selected, the sheets are distributed first to the top bin 60 so that the operator can directly take-out the sheets from each of the bins 60.

More particularly, whether the finishing mode flag is "1" or not is checked at step S140. When is "1", whether the sheets are present or not in the bins 60 is checked by the on-off signal of the sensor Se5 at step S141. When the sheets are absent, whether the alarm flag F11 is "1" or not is checked at step S141*a*. This alarm flag F11 is set to "1" at steps S158 and S161 which will be explained later, but, when the alarm flag F11 is "1", it is reset to "0" at step S141*b*, and the inhibition of system operation is canceled at step S141*c*. Then, whether the bottom bin detection switch SW1 is turned on or not, that is, whether or not the bins 60 are at the bottom bin position X1, the home position of the bins 60 when the finishing mode is selected, and whether the distribution of the sheets in the finishing mode is possible are checked at step S142. Thus, when the result of the check is "Yes", the processing goes to step S148, and a direction-of-rotation flag is reset to "0" in order to reverse the action of the bins 60 for the sorting operation or to reverse the rotation of floating cam motor (not shown in the drawings). When the result of the chick is "No" at step S142, the processings at steps S143 through S147 are executed to shift the bins 60 to the bottom bin position X1. That is, the floating cam motor is made to turn towards its normal direction at step S143, and sorter wait is applied at step S144. The sorter wait means the processing to inhibit the copying operation so that the sheets will not be transported to the sorting unit 41 while the bins 60 is in motion. When that the bottom bin detection switch SW1 is turned on is confirmed at step S145, the floating cam motor is turned off at step S146. The sorter wait is canceled at step S147. The direction-of-rotation flag for the floating cam 50 is reset to "0" at step S148 in order to reverse direction of rotation of the floating cam 50 from said step on.

On the other hand, when the finishing mode is not selected, whether the sheets are present or absent in the bins 60 is checked by the on-off signal of the sensor Se5 at step S149. When the sheets are absent, whether the top bin direction switch SW2 is turned on or not at step S150, that is, whether or not the bin 60 is at the top bin position X2, the home position at the time of the finishing mode, and whether the distribution of the sheets in the finishing mode is possible or not are checked. Thus, when the result of the check is "Yes", the processing proceeds to step S156, and the direction-of-rotation flag for the floating cam 50 is set to "1" to permit the normal rotation of the floating cam 50. When said result is "No", the processings at steps S151 through S155 are executed to shift the bins 60 to the top bin position X2. That is, the rotation of the floating cam 50 is reversed at step S151; the sorter wait is applied at step S152; that the top bin detection switch SW2 is turned on is confirmed at step S153; and the motor of the floating cam 50 is turned off at step s154. Subsequently, the sorter wait is canceled at step S155. the direction-of-rotation flag for the floating cam 50 is set to "1" at step S156 to let the floating cam 50 rotates towards its normal direction from said step on.

Further, when the presence of the sheets in the bins 60 is detected at said steps S141 and S149, whether the sheet counter registers "0" or not is checked at steps S157 and S160. When judged to be "0", the alarm flag F11 is set to "1" at steps S158 and S161 in order to prepare for lighting LED 160 for indicating the need of the removal of the sheets. The system operation is inhibited at steps S159 and S162, and the processing returns to the main routine.

Next, at step S163, whether the ejection switch SW3 of the copying machine 1 is on-edge or not is checked. This is, when the front end of the sheet has arrived to the ejection switch SW3, the sorter transport motor is turned on at step S164, and whether the sorter ejection sensor Se1 is off-edge or not is checked at step S165. More particularly, the sheet is judged to have distributed to the bin 60 when the rear end of the sheet has passed the ejection sensor Se1. When the ejection sensor Se1 is off-edge, the timer of the sorter transport motor is started at step S166. The number of sheets to be counted is increased at step S167. When the time set by the timer of the sorter transport motor has passed at step S168, the sorter transport motor is turned off at step S169. Subsequently, whether the sheet transported last is the last sheet or not is checked at step S170. When judged to be the last sheet, the direction-of-rotation flag for the floating cam 50 is reversed at step S171. That is, when the direction-of-rotation flag for the floating cam 50 has been reset to "0", it is set to "1", and it is reset to "0" when it has been set to "1". When said sheet is not the last sheet is judged at said step S170, the position of the direction-of-rotation flag for the floating cam 50 is checked at step S172 in order to continue the sorting operation. When said position is judged to be "0", the rotation of the floating cam motor is reversed at step S173, and, when said position is judged to be "1", the rotation of said motor is normalized at step S174. More particularly, the sheets are distributed by moving them up and down from the bottom bin 60 to the top bin 60 or from the top bin 60 to the bottom bin 60.

Then, whether the finishing mode flag is "1" or not is checked at step S175. When is "1", the number (M) of the sheets per bin is calculated at step S175*a*, and the number (M) of the sheets per bin and the allowable number (Cb) of sheets for stapling (refer to step S53) are compared at step S176. When the number (M) of sheets per bin is larger than the allowable number (Cb) of sheets for stapling, the alarm flag F5 is set to "1" at step S177 in order to prevent the defective stapling, and the preparation is made for indicating that the number (M) of sheets is too large for the capacity of the stapling unit 90. The copying flag is reset to "0" at step S178. Whether the print switch 121 is turned on or not is checked at step S179. Whether the ADF start switch 141 is turned on or not is checked at step S180. When either one of the print switch 121 or the ADF start switch 141 is turned on, that is, when the operator's will for the execution of the copying operation regardless of the alarm is confirmed, the finishing mode flag is reset to "0" at step S181; the alarm flag F5 is reset to "0" at step S182; and the copying flag is set to "1" at step S183 for enabling the execution of the processing in the sorting mode so that this subroutine can be completed.

When the operator wants to terminate the copying operation and execute the finishing processing when the alarm for the oversupply of the sheets for the capacity of the stapling unit 90 during the execution of the processing at steps S176 and S177, the operator is required only to turn on the finish start switch 158 (refer to step S210).

Figure 33:
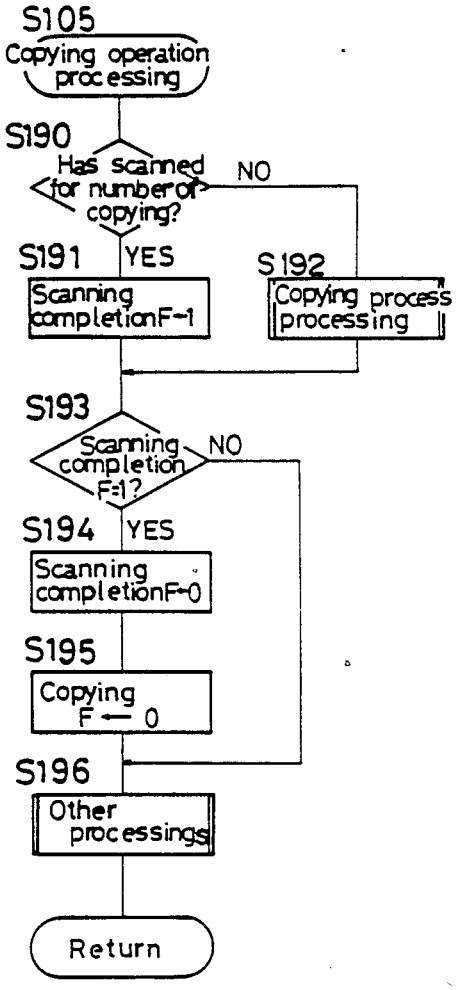
FIG. 33 is a flow chart showing a subroutine for the copying operation processing.

FIG. 33 shows a subroutine for the copying operation processing to be executed at said step S105.

First, whether the optical system 4 has scanned each copy for several minutes or not is checked at step S190. When this result is "Yes", the scanning completion flag is set to "1" at step S191. When the result is "No", a subroutine for the processing of copying process is executed at step S192. This subroutine is designed for the execution of the ordinary copy process by the copying machine 1. The details of this subroutine are omitted here.

Then, after confirming that the scanning completion flag is "1" at step S193, the scanning completion flag is reset to "0" at step S194; the copying flag is reset to "0" at step S195; and a subroutine for other processing is executed at step S196.

Figure 34A:
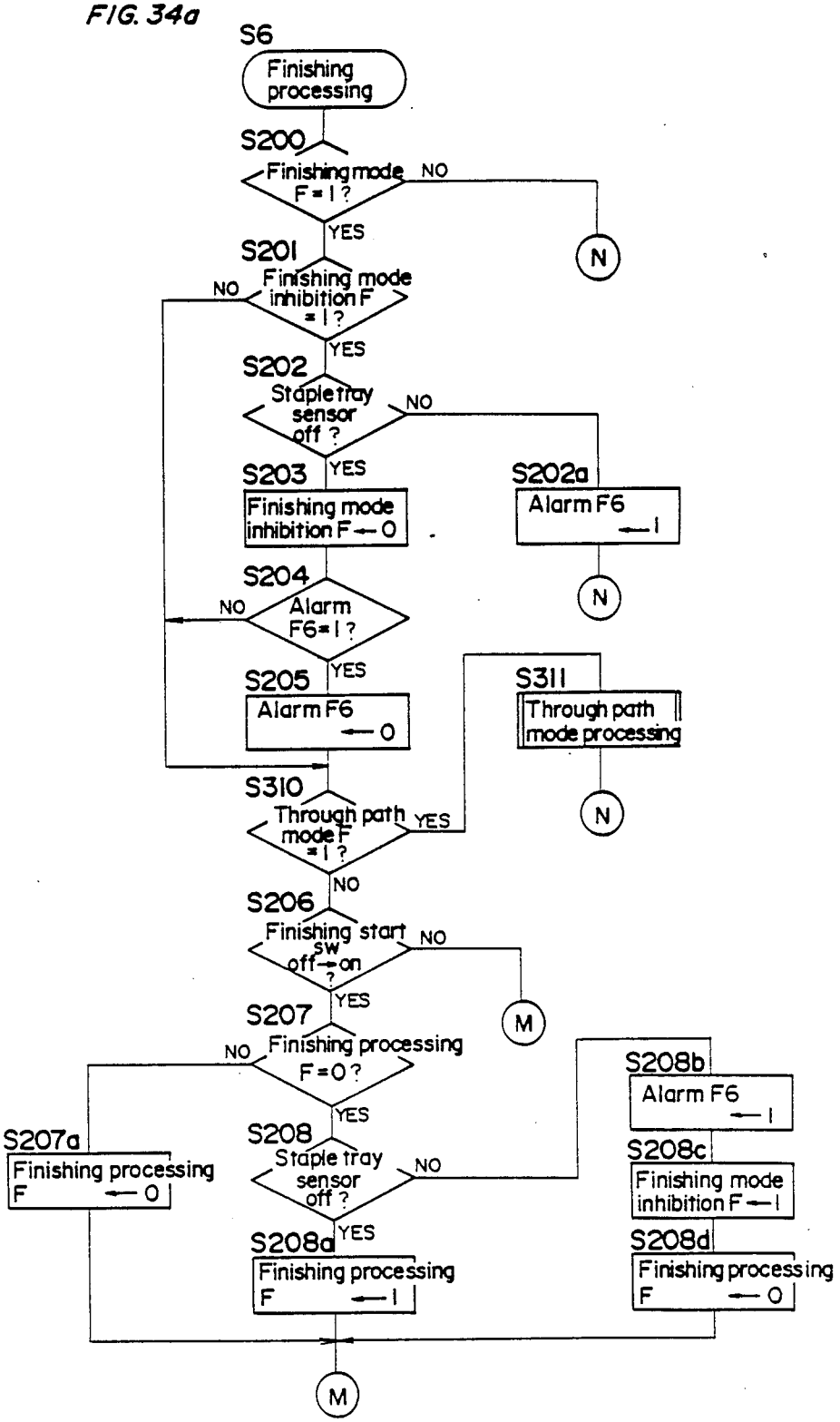
FIGS. 34*a* and 34*b* are flow charts showing a subroutine for the finishing processing.
Figure 34B:
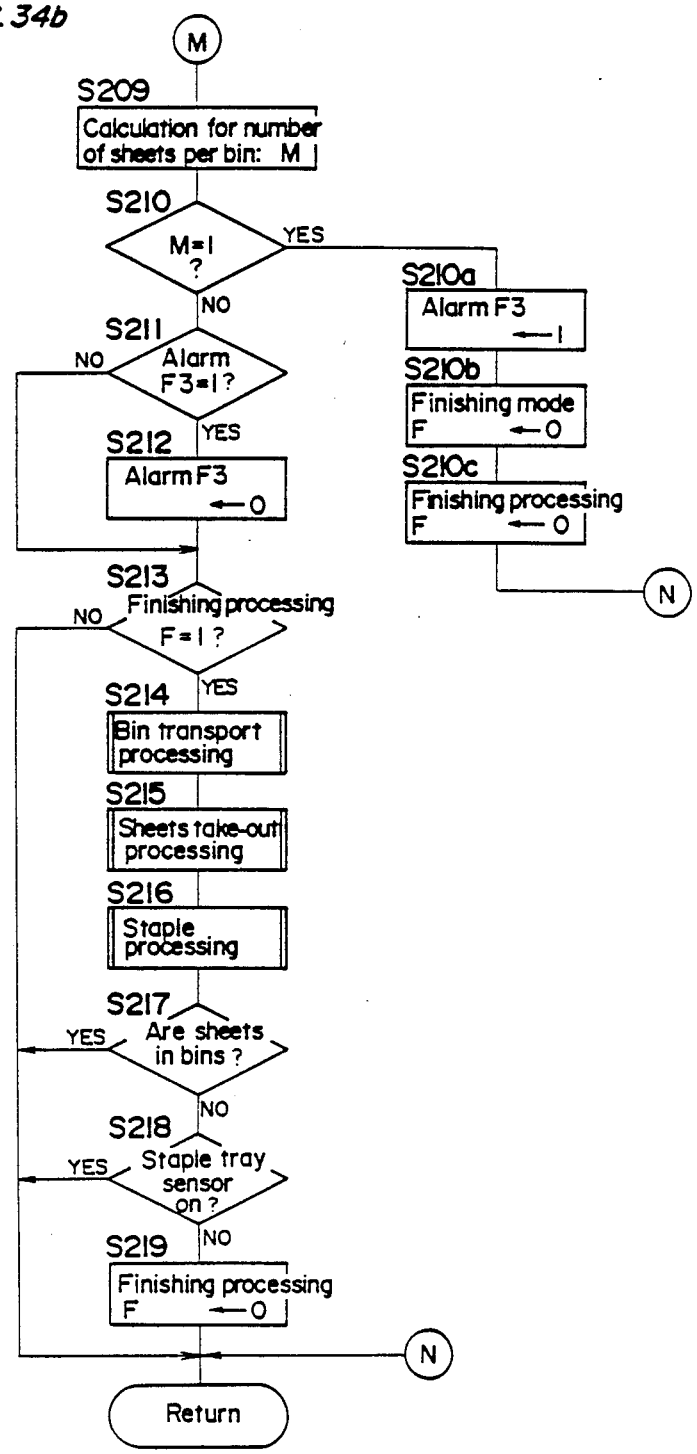

FIGS 34*a*, 34*b* show a subroutine for the finishing processing to be executed at step S6 of the main routine.

First, whether the finishing mode flag is "1" or not is checked at step S200. When is "0", the processing is terminated at once. When is "1", whether a finishing mode inhibition flag is "1" or not is checked at step S201. When is "0", the processing goes to step S310. When is "1", whether the presence or absence of the sheets on the staple tray 91 is checked by the on-off signal of the sheet detection sensor Se6 on the staple tray 91 at step S202. When the presence of the sheets on the tray 91 is detected from that the sheet detection sensor Se6 is on, the alarm flag F6 is set to "1" at step S202*a* in order to prepare for indicating the necessity of removing the sheets from the staple tray 91 so that the troubles such as the mixing of the sheets already on the staple tray 91 with the sheets transported later onto the staple tray 91 and the oversupply of the sheets for the capacity of stapling unit 90 can be prevented.

On the other hand, that the sheets are not present on the staple tray 91 is confirmed at step S202, the finishing mode inhibition flag is reset to "0" at step S203, in order to cancel the inhibition of the finishing mode operation. Next, whether the alarm flag F6 is "1" or not is checked at step S204. When is "1", the flag F6 is reset to "0" at step S205, when is "0", the processing goes to step S310. Subsequently, at step S310, whether the through path mode flag is "1" or not is checked. The through path mode has been set to "1" when the set number (A) is "1" and finishing mode is selected by the operator. Then, the through path mode flag is "1", the through path mode processing is executed at step S301.

In contrast, when the through path mode flag is "0", whether the finishing start switch 158 is changed to on from off or not is checked at step S206. When the switch 158 is changed to on, whether the finishing processing flag is "0" or not is checked at step S207. When the flag is "1", that is, the finishing mode has been currently selected, the finishing processing flag is reset to "0" at step S207*a*, the processing goes to step S209. When the finishing processing flag is "0", that is, the switch 158 has been turned on to select the finishing mode, then, whether the sheets are present or not on the staple tray 91 is checked again by the on-off signal of the sensor Se6 at step S208. When the sheets are absence, the finishing processing flag is set to "1" to execute the finishing operation at step S208*a*, the processing goes to step S209. If the sheets are present, the processing at steps S208*b*, S208*c* and S208*d* are executed not only for giving alarm but also for cancelling the finishing mode so that the troubles such as stapling unnecessary sheets and defective stapling as are described previously. That, is, the alarm flag F6 is set to "1" at step S208*b* in order to prepare for indicating the necessity of removing the sheets from the staple tray 91. Then, the finishing mode inhibition flag is set to "1" at step S208*c* and the finishing processing flag is reset to "0" to cancel the stapling operation at step S208*d*, and the processing goes to step S209.

At step S209, the number (M) of sheets per bin is calculated. At step S210, whether the number (M) of sheets is "1" or not is checked. More particularly, when only one sheet distributed to each of the bins 60, there is no need of stapling operation. Thus, when the number (M) of sheets per bin is found to be "1" at said step S210, the alarm flag F3 is set to "1" at step S210*a* in order to prepare for indicating that the finishing mode is impossible. Simultaneously, the finishing mode flag and the finishing processing flag are reset to "0" at steps S210*b* and S210*c* to cancel the finishing mode, and the subroutine is terminated. On the other hand, when it is confirmed that the number (M) of sheets per bin is not "1", whether the alarm flag F3 is "1" or not is checked at step S211. When the flag F3 is "1", the flag F3 is reset to "0" at step S212.

Next, at step S213, it is checked to be whether the finishing processing flag is "1" or not, when the flag is "0", the subroutine is terminated. When the flag is "1", only in such case, the finishing processing may be executed. That is, a subroutine for the bin transport processing is executed at step S214, a subroutine for the sheet take-out processing at step S215, and a subroutine for the staple processing at step S216 respectively. Then, when these processing have been completed, whether the presence or absence of the sheets in each of the bins 60 is checked at step S217 and whether the presence or absence of the sheets on the staple tray 91 is checked at step S218. When both the sheets are absent, the finishing processing flag is reset to "0" at step S217.

Further, in the case of the finishing processing subroutine, that the sheets have been removed from the staple tray 91 has to be confirmed at step S202, and then the alarm flag F6 has to be reset to "0" at step S205 to cancel the inhibition of the finishing mode. The finishing processing may be resumed automatically through a timer or by the input through the finishing start switch 158 after canceling the inhibition of the finishing mode.

Figure 35:
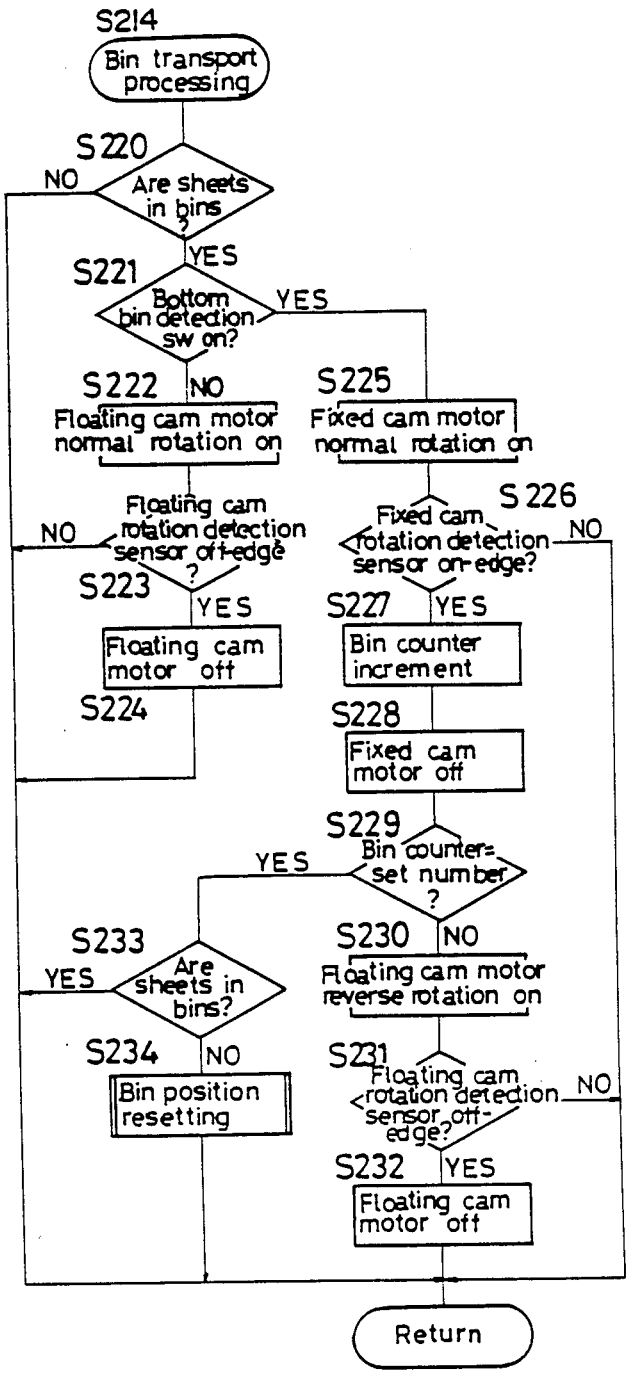
FIG. 35 is a flow chart showing a subroutine for the bin transport processing.

FIG. 35 shows a subroutine for the bin transport processing to be executed at said step S214.

The presence or absence of the sheets in the bins 60 is checked by the on-off signal of the sensor Se5 at step S220, and the processing is terminated at once when the sheets are absent in the bins 60. Actually, such condition cannot occur, but it can occur when the operator takes out the sheets from the bins 60 immediately after completing the copying and sorting operation. When the sheets are present, they are detected by whether the bottom bin detection switch SW1 is on or not at step S221. When the switch SW1 is not on, the motor of the floating cam 50 is turned towards its normal direction at step S222 in order to shift the floating cam 50 to the bottom bin position X1, and said motor is turned off at step S224 when it is confirmed that the switch for detecting the rotation of the floating cam 50 is off-edge at step S223. The processing at steps S222, S223 and S224 will be continued until the floating cam 50 moves to the bottom bin position X1.

When the floating cam 50 has moved to the bottom bin position X1, that is, when it is judged that the bottom bin detection switch SW1 is turned on at said step S221, the fixed cam motor is turned towards its normal direction at step S225, and whether the fixed cam rotation detection sensor Se2 is on-edge or not is checked at step S226. When the sensor Se2 is on-edge, this indicates that the bins 60 at the bottom bin position X1 has descended to sheet take-out position X3, and this is followed by the increment of the bin counter at step S227 and turning off of the fixed cam motor at step S228.

Then, whether the reading of the bin counter is equal to the set number (A) (refer to step S10) or not is checked at step S229. When the reading of the bin counter is smaller than the set number (A), the processing for letting the next bin 60 move to the sheet take-out position X3 is executed. That is, the rotation of the floating cam motor is reversed at step S230, and when the off-edge of the sensor for detecting the rotation of the floating cam motor is confirmed at step S231, the floating cam motor is turned off at step S232. This causes the next bin 60 to move to the bottom bin position X1. These steps S230, S231 and S232 will be repeated until the reading of the bin counter becomes equal to the set number (A).

When the reading of the bin counter has become equal to the set number (A), the stapling operation is completed, and a subroutine for resetting the bin position is executed at step S234 after confirming that the sheets are not present in the bins 60 at step S233.

Figure 36:
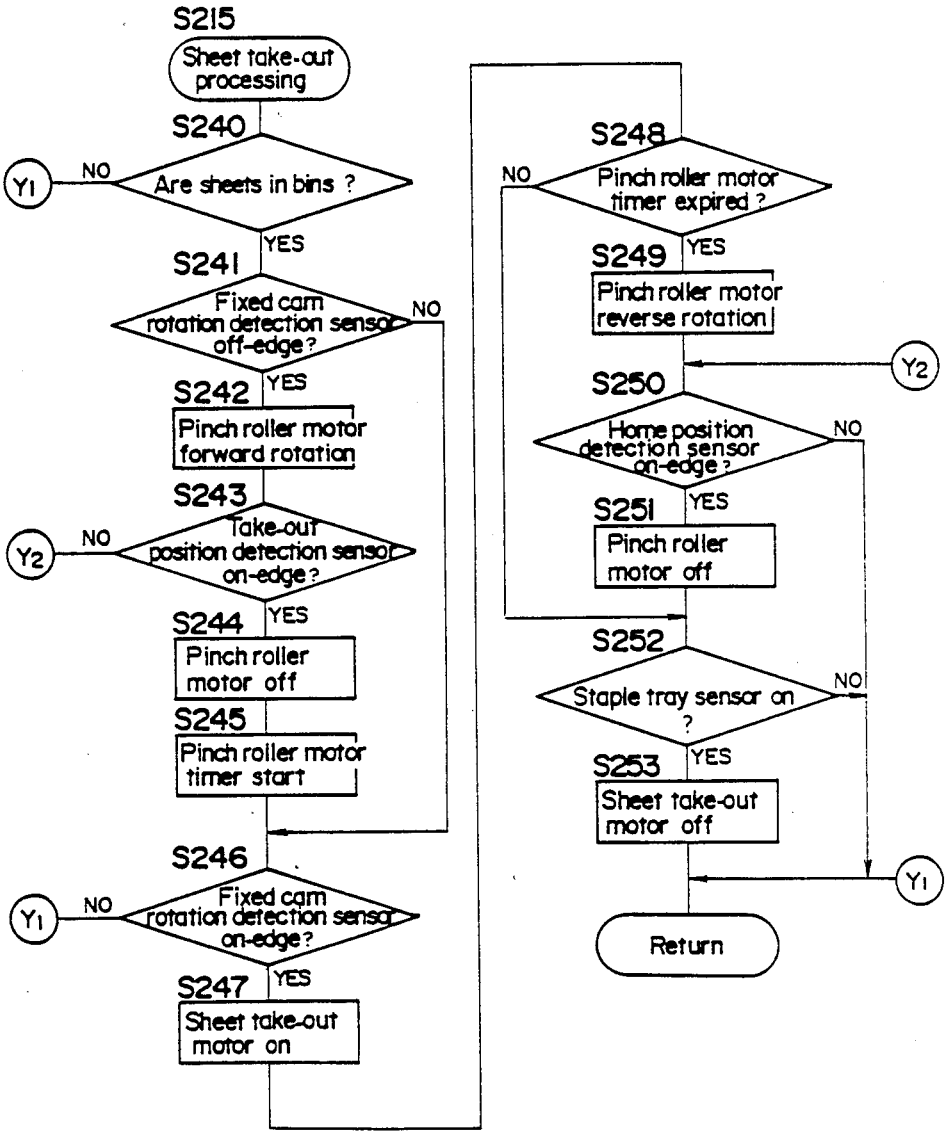
FIG. 36 is a flow chart showing a subroutine for the sheet take-out processing.

FIG. 36 shows a subroutine for the sheet take-out processing to be executed at said step S215. This subroutine is for the execution of the processing for transporting the sheets which have been brought down to the sheet take-out position X3 by the bins 60 to the staple tray 91 by the sheet transport unit 80.

First, whether the sheets are present in the bin 60 which is coming down to the sheet take-out position X3 or not is checked by the on-off signal of the sensor Se5 at step S240. When the sheets are absent, an alarm is given (by the system not shown in the drawings), and the subroutine is terminated at once. When the presence of the sheets is confirmed, whether or not the fixed cam rotation detection sensor Se2 is off-edge, or whether the fixed cam 70 has started to turn towards its normal direction or not is checked at step S241. When judged to be off-edge, or when the bin 60 has begun descent to the sheet take-out position X3 following the start of the normal rotation of the fixed cam 70, the pinch roller motor is turned on in forward rotation to actuate the pinch roller 76 and the shaft 82 of the guide plate 83 at step S242. When judged that the sensor Se2 is not just off-edge, the processing goes to step S246.

Next, at step S243, whether the take-out position detection sensor Sell is on-edge or not, or whether the pinch roller 76 and the guide plate 83 are turned to the position shown in FIGS. 8 and 11 or not is checked. When the sensor Sell is not on-edge, the processing goes to step S250, when the sensor Sell is just on-edge, the pinch roller 75 and the guide plate 83 has been turned completely and then the sheets on the bin 60 have been caught between the take-out roller 75 and the pinch roller 76 at the sheet take-out position X3. Therefore, the pinch roller motor is turned off at step S244, a pinch roller motor timer is started at step S245.

At step S246, whether the fixed cam rotation detection sensor Se2 is on-edge or not, that is, whether the bin 60 has descended completely to the sheet take-out position X3, is checked. When judged to be on-edge, the sheet take-out motor is turned on at step S247, and this causes the sheets to be transported to the staple tray 91 by the rollers 75, 76, 81*a* and 81*b*. When it is confirmed that the pinch roller motor timer has been expired, the pinch roller motor is turned on in reverse rotation to actuate the shaft 82 at step S248.

Then, at step S250, whether the home position detection sensor Se10 is on-edge or not, or whether the pinch roller 76 and the guide plate 83 are returned to the home position shown in FIG. 11 or not is checked. When the sensor Se10 is just on-edge, the pinch roller motor is turned off at step S251, and this causes the pinch roller 76 and the guide plate 83 to be moved upward away from the take-out roller 75. This is because the pinch roller 76 and the guide plate 83 need to move away from the sheet take-out position X3 before the next bin 60 starts to descend from the bottom bin position X1 so that the interference with the sheets distributed on the bin 60 can be prevented and the end of the sheets is regulated by the guide plate 83.

Next, at step S252, when it is confirmed that the sheets are stored in the staple tray 91 by the on signal of the sensor Se6, the sheet take-out motor is turned off at step S253, and the subroutine is terminated.

Figure 37A:
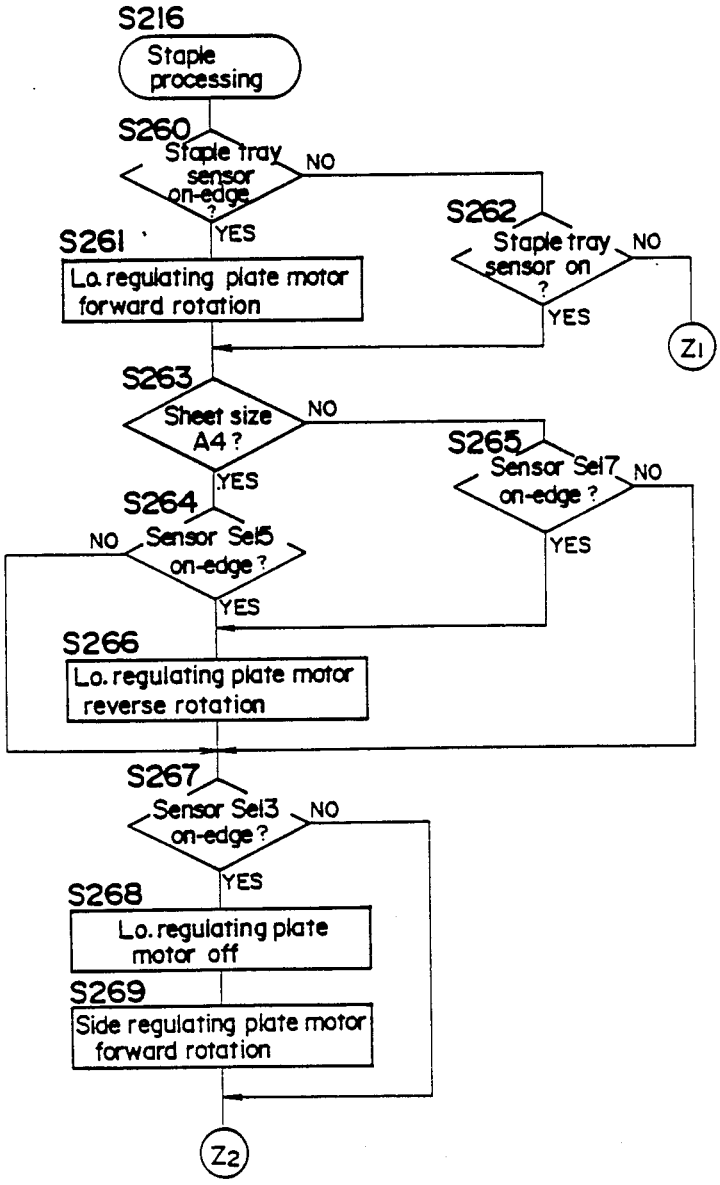
FIGS. 37*a* and 37*b* are flow charts showing a subroutine for the staple processing.
Figure 37B:
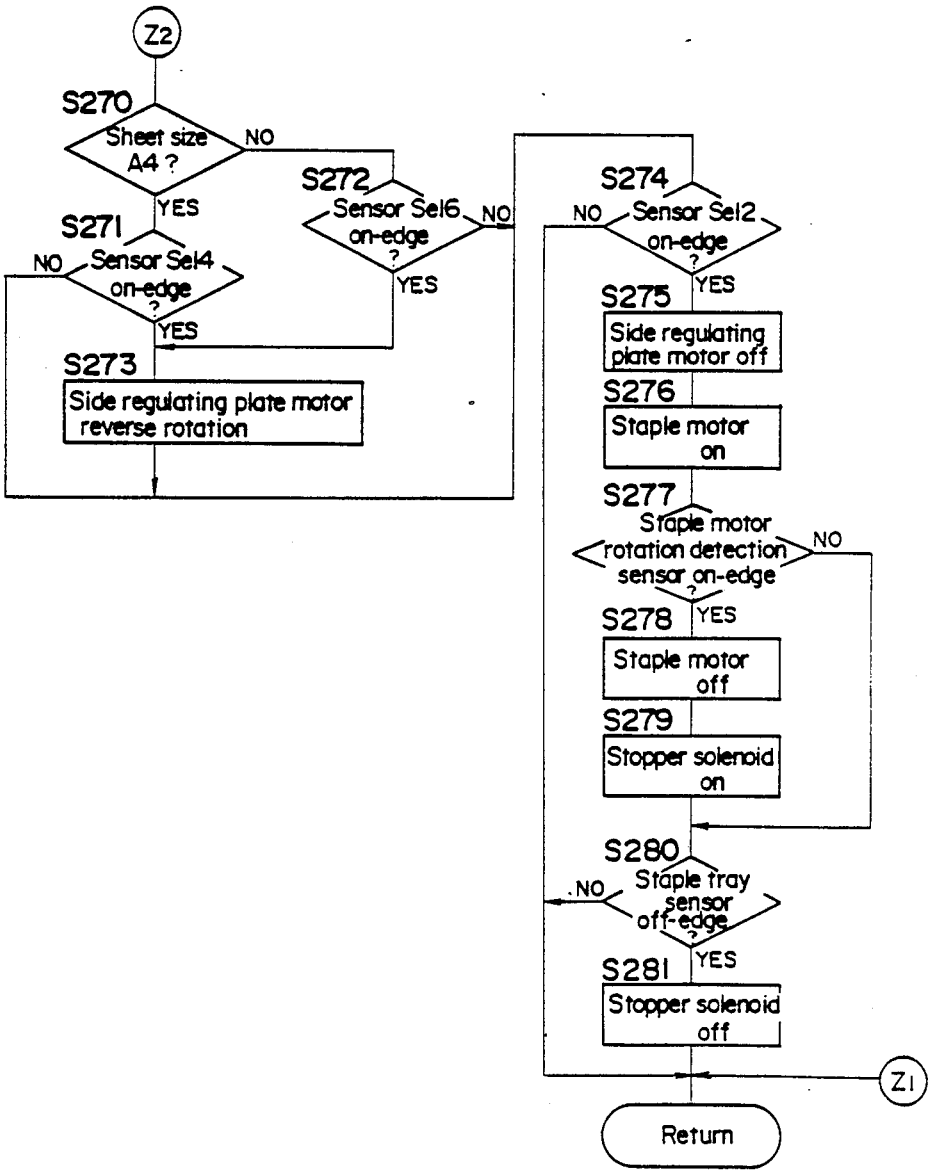

FIGS. 37*a* and 37*b* show a subroutine for the staple processing to be executed at said step S216.

First, whether the sensor Se6 on the staple tray 91 is on-edge or not is checked at step S260. This sensor Se6 is turned on when the sheets are supplied onto the tray 91. Thus, when the sensor Se6 is on-edge, the motor for the longitudinal regulating plate 190 is turned on in forward rotation at step S261, processing goes to step S263. In contrast, when the sensor Se6 is not on-edge, it is checked whether the sensor Se6 is on status at step S262. When the sensor Se6 is off status, i.e. there are no sheets on the staple tray 91, the subroutine is completed. When the sensor Se6 is on status, i.e. there are sheets on the staple tray 91, the processing goes to step S263.

At step S263, it is checked whether the sheets transported to the staple tray 91 are in A4 size or not. When the sheets are in A4 size, it is checked whether the A4 size detection sensor Se15 for the longitudinal regulating plate 190 is on-edge or not at step S264. When the sensor Se15 is on-edge, i.e. the longitudinal regulating plate 190 is moved to the position corresponding to A4 size to longitudinally align the sheets in cooperation with the stopper 96, the motor is turned on in reverse rotation at step S266.

On the other hand, when it is judged the sheets are not in A4 size at said step S264, the sheets are judged to be in B5 size because the stapling unit 90 in this embodiment carries out the stapling question only for A4 or B5 size sheets. Then, it is checked whether the B5 size detection sensor Se17 for the longitudinal regulating plate 190 is on-edge at step S265. When the sensor Se17 is on-edge, and the longitudinal alignment of the sheets is completed, the motor is turned on in reverse rotation at step S266 in the same manner as mentioned before.

Subsequently, the processing goes to step S267 to judge whether the home position detection sensor Se13 for the longitudinal regulating plate 190 is on-edge or not. When the sensor Se13 is on-edge, the motor is turned off at step S268. With this operation, the regulating plate 190 is made retracted behind the guide plate 84*a* as shown by the solid line in FIG. 13 to prevent the regulating plate 190 from interfering with the subsequent transport of sheets from the bin 60.

Next, the subroutine proceeds to steps S269 through S275 to laterally align the sheets. These steps are fundamentally the same as the steps S261, and S263 to S268. First, the motor 184 for the side regulating plate 180 is turned on in forward rotation at step S269. When the sheets are judged to be in A4 size at step S270, after confirming that the A4 size detection sensor Se14 for the side regulating plate 180 is on-edge at step S271, the motor 184 is turned on in reverse rotation at step S273. When the sheets are in B5 size, after confirming that the B5 size detection sensor Se16 is on-edge at step S272, the motor 184 is turned on in reverse rotation at step S273. Subsequently, it is checked whether the home position detection sensor Se12 for the side regulating plate 180 is on-edge or not at step S274. When the sensor Se12 is on-edge, the motor 184 is turned off at step S275, thereby the lateral alignment of the sheets, which is preceded by the longitudinal alignment, is completed.

Then, at step S276, the staple motor is turned on, and when the rotation detection sensor Se4 of the staple motor is judged to be on-edge at step S277, or when the sheets are stapled with staple 106 following the movement of the head 105, the staple motor is turned off at step S278. Subsequently, at step S279, the stopper solenoid is turned on. This causes the stopper 96 to withdraw from the bottom end of the staple tray 91, and the sheets slide downward onto the stack tray 111. Then, when the sensor Se6 of the staple tray 91 is judged to be off-edge at step S280, or when the ejection of the stapled sheets into the stack tray 111 is detected, the stopper solenoid is turned off at step S281 to return the stopper 96 to the bottom end of the tray 91, and the execution of this subroutine is terminated.

Figure 38A:
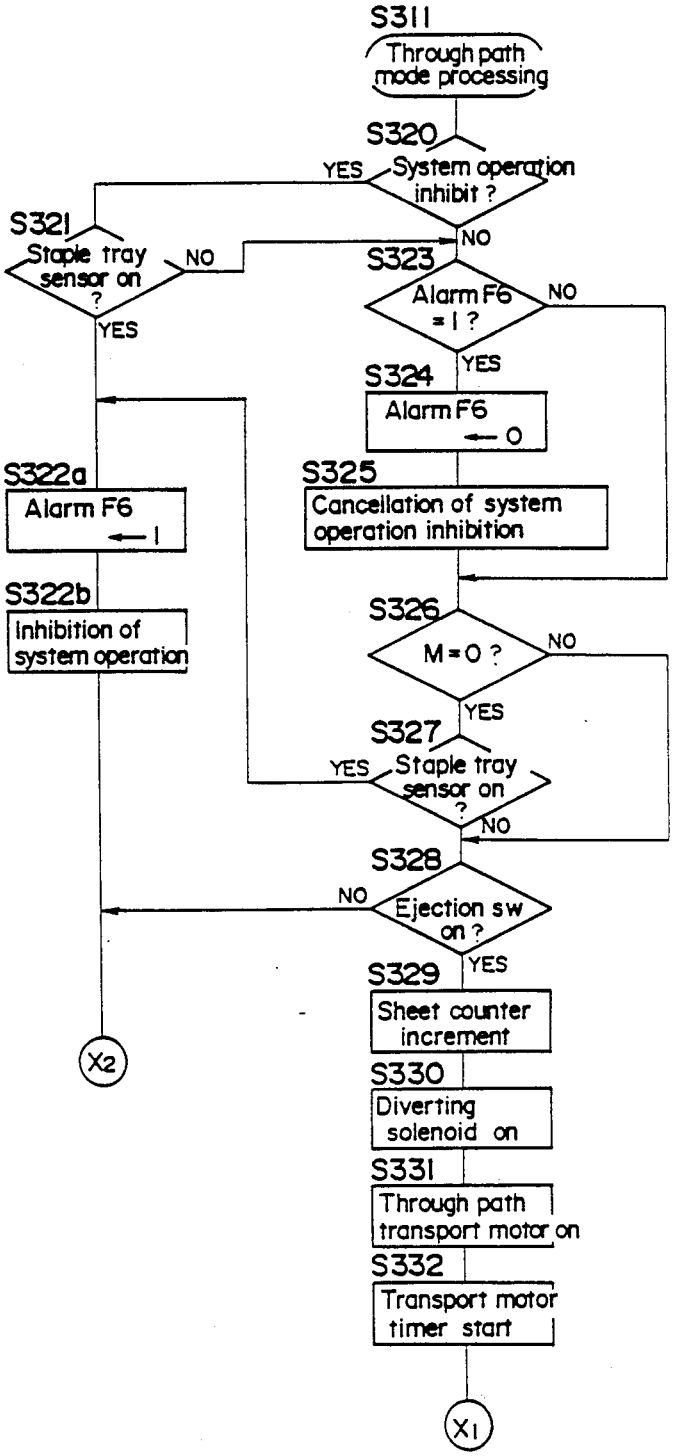
FIGS. 38*a*, 38*b*, and 38*c* are flow charts showing a subroutine for the through path mode processing.
Figure 38B:
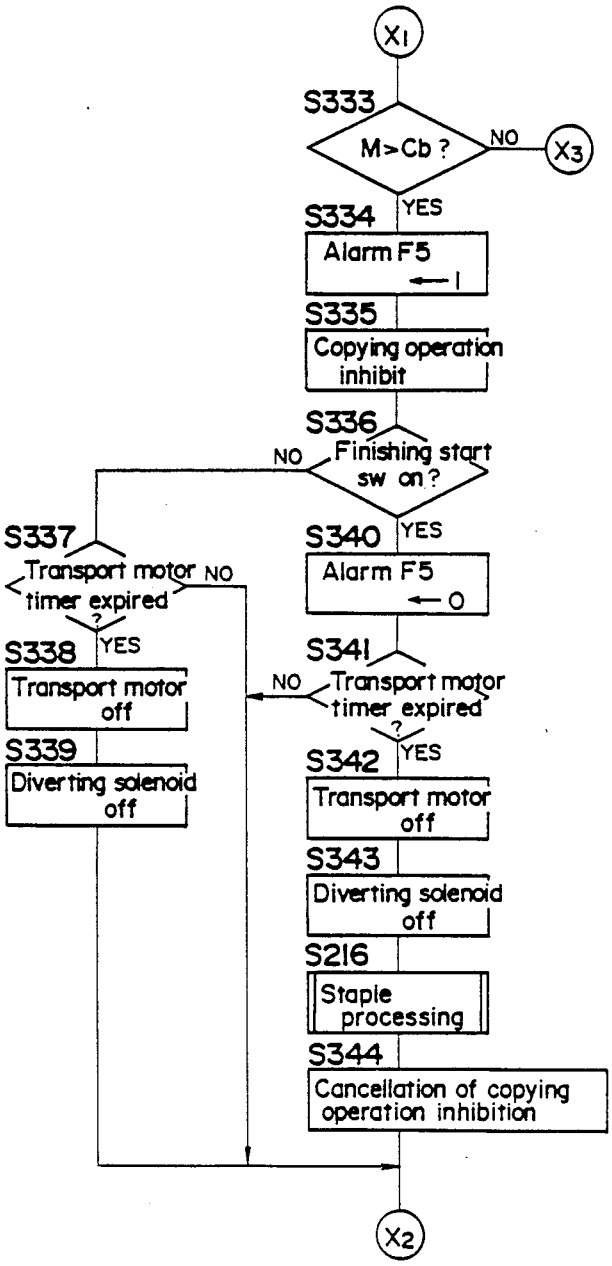
Figure 38C:
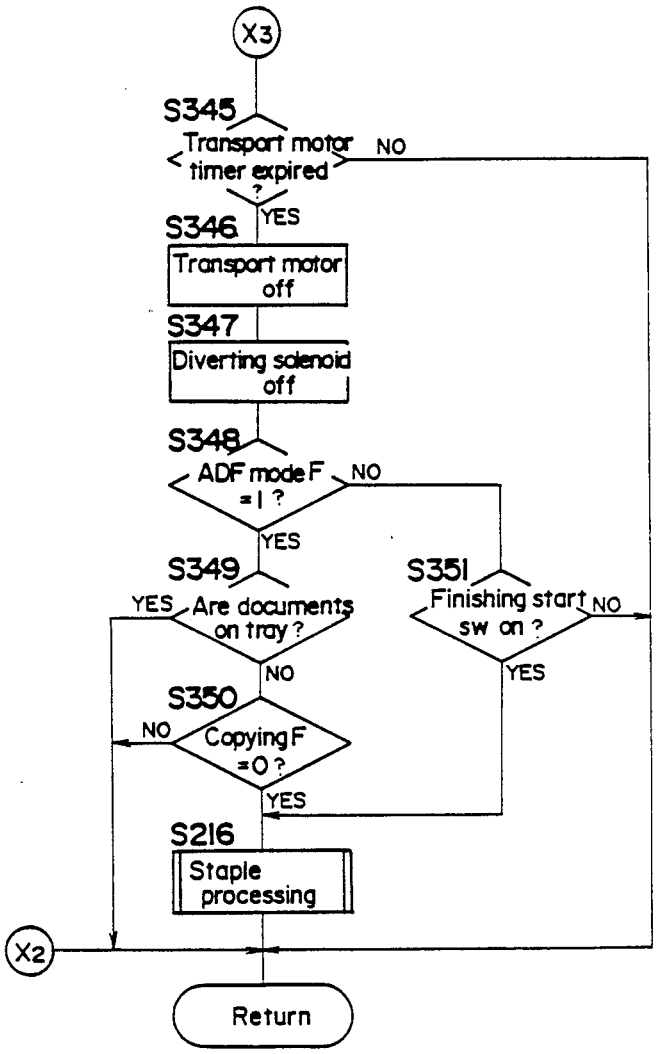

FIGS. 38*a*, 38*b* and 38*c* show a subroutine for the through path mode processing to be executed at step S311. In this subroutine, the sheets ejected one after another from the copying machine 1 are directly transported to the staple tray 91 without being distributed to the sorting unit 41.

First, it is checked whether the system operation is inhibited or not at step S320. When the system operation is inhibited, it is checked whether there are sheets on the staple tray 91 according to on or off status of the sensor Se6 at step S321. When the sensor Se6 is on status, or there are sheets on the staple tray 91, the alarm flag F6 is set to "1" at step S322*a* so as to evade the undesired operation of stapling sheets from the copying unit together with those already on the staple tray 91. In this case, the system operation is inhibited at step S322*b*, and the processing returns to the main routine.

When the system operation is not inhibited and the sensor Se6 is off status, it is checked whether the alarm flag F6 is "1" or not at step S323. When the flag F6 is "1", it is reset to "0" at step S324, and then the inhibition of the system operation is cancelled at step S325.

It is checked whether the number (M) of sheets per bin is "0" or not at step S326. When the number (M) is "0", it is checked again whether the sensor Se6 is on status or not at step S327. When the sensor Se6 is on status, the processing returns to the main routine after carrying out the processes at steps S322*a* and S322*b*. When the sensor Se6 is off status, or there are no sheets on the staple tray 91, after confirming that the ejection switch SW3 in the copying machine 1 is turned on at step S328, i.e. the leading edge of a copied sheet reaches the ejection switch SW3, the count number of sheets is increased at step S329. Meanwhile, the diverting solenoid is turned on at step S330 to move the diverter 201 into the position indicated by the solid line in FIG. 2, thereby the sheets ejected from the copying machine 1 are transported to the path 200. Then, the transport motor for the path 200 are turned on at step S331 to rotate the rollers 205 and 206, and a transport motor timer is made to start at step S332.

Next, it is checked whether or not the count number (M) of sheets per bin exceeds the allowable stapling number (Cb) for the stapling operation at step S333. When the number (M) does not exceed the allowable stapling number (Cb), and after confirming that the transport motor timer is expired at S345, the motor is turned off at step S346 and the diverting solenoid is turned off at step S347. Then, it is checked whether the ADF mode flag is "1" or not at step S348. When the ADF mode flag is "1", it is checked whether or not there are documents on the document tray 31 according to on or off status of the sensor Se37 at step S349, and then it is checked whether the copying flag is "0" or not at step S350. When there are documents on the docment tray 31 or the copying flag is "1", the processing returns to the main routine. When there are no documents on the document tray 31 and the copying flag is "0", the aforesaid subroutine for the staple processing is carried out at step S216.

Then, when it is judged the ADF mode flag is "1" at said step S348, after confirming that the finishing start switch 158 is turned on at step S351, the subroutine for the staple processing is carried out at step S216.

Meanwile, when the number (M) of sheets per bin is judged to exceed the allowable stapling number (Cb) at step S333, the alarm flag F5 is set to "1" at step S334, and the copying operation is inhibited at step S335. Then, it is checked whether the finishing start switch 158 is turned on or not at step S336. When the switch 158 is not turned on, after confirming the finish of the transport motor timer at step S337, the motor is turned off at step S338, and the diverting solenoid is turned off at step S339.

When it is judged the switch 158 is turned on, the alarm flag F5 is reset to "0" at step S340, after confirming the finish of the transport motor timer at step S341, the transport motor is turned off at step S342, the diverting solenoid is turned off at step S343. Subsequently, the aforesaid subroutine for the staple processing is carried out at step S216, and the inhibition of the copying operation is cancelled at step S344, the processing returned to the main routine.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A copying apparatus comprising:

image forming means for copying an original image onto a predetermined number of sheets;

sorting means for distributing the sheets ejected from said image forming means to a plurality of bins;

binding means for binding the sheets taken-out from each of the bins;

a first path for transporting sheets having an original image formed thereon by said image forming means from the image forming means to said sorting means;

a second path for transporting the sheets having an original image formed thereon by said image forming means from the image forming means to said binding means;

diverting means for diverting the sheets to either said first path or said second path;

inputting means for inputting the number of copy sets to be prepared from one original;

designation means for designating a sorting mode;

a first control means for controlling said diverting means to conduct sheets to said first path in accordance with the designation of the sorting mode; and second control means for controlling said diverting means to conduct sheets to said second path regardless of said first control means when the input number of copy sets is 1.

2. A copying apparatus comprising:

image forming means for copying an original image onto a predetermined number of sheets;

binding means for binding the sheets having an original image formed thereon by said image forming means in accordance with either a first mode or a second mode, the first mode being arranged for sorting the sheets to a plurality of bins and then for binding the sheets in each of the bins, and the second mode being arranged for binding the sheets without sorting the sheets to the bins;

inputting means for inputting the number of copy sets to be prepared from one original; and selecting means for selecting either said first mode or said second mode in accordance with the input number of copy sets.

3. A copying apparatus comprising:

image forming means for copying an original image on sheets;

sorting means having a plurality of bins stacked in a vertical direction, each of which has an opening at its end portion;

sheet take-out means disposed under said sorting means and having a first roller and a second roller which is movable between an actuating position, in which said second roller presses on said first roller and a non-actuating position, in which said second roller is moved away from said first roller;

a bin driving mechanism for causing each of the bins to move down to the sheet take-out position at which position said first roller contacts with the lower surface of the sheets through said opening of said bin;

a guide member movable between a first position for guiding the end of the sheets on each of the bins moving to the sheet take-out position and a second position for guiding the upper surface of the sheets being taken-out from each of the bins at the sheet take-out position;

a second roller driving mechanism for holding said second roller at the non-actuating position while each of the bins moves to the sheet take-out position and for moving said second roller to the actuating position when each of the bins reaches the sheet take-out position, wherein the sheets on said bin are pinched by said first roller and said second roller and taken-out from said bin;

a guide member driving mechanism for holding said guide member at the first position while each of the bins moves to the sheet take-out position and for moving said guide member to the second position when each of the bins reaches the sheet take-out position; and binding means for binding the sheets taken-out from each of the bins.

* * * * *